US011015329B2

(12) United States Patent
Loberger et al.

(10) Patent No.: US 11,015,329 B2
(45) Date of Patent: May 25, 2021

(54) LAVATORY DRAIN SYSTEM

(71) Applicant: Bradley Corporation, Menomonee Falls, WI (US)

(72) Inventors: John M. Loberger, Germantown, WI (US); Scott M. Kluck, Mequon, WI (US); William L. Haas, Richfield, WI (US)

(73) Assignee: Bradley Corporation, Menomonee Falls, WI (US)

( * ) Notice: Subject to any disclaimer, the term of this patent is extended or adjusted under 35 U.S.C. 154(b) by 0 days.

(21) Appl. No.: 16/569,995

(22) Filed: Sep. 13, 2019

(65) Prior Publication Data

US 2020/0002926 A1 Jan. 2, 2020

Related U.S. Application Data

(63) Continuation-in-part of application No. 16/057,220, filed on Aug. 7, 2018, now Pat. No. 10,697,160, (Continued)

(51) Int. Cl.
*E03C 1/14* (2006.01)
*A47K 10/48* (2006.01)

(52) U.S. Cl.
CPC ..... *E03C 1/14* (2013.01); *A47K 10/48* (2013.01)

(58) Field of Classification Search
CPC ..... E03C 1/00; E03C 1/02; E03C 1/12; E03C 1/26; E03C 1/14; A47K 10/48
(Continued)

(56) References Cited

U.S. PATENT DOCUMENTS 540,235 A 6/1895 Ciifford et al.
D30,136 S 2/1899 Eckerson
(Continued)

FOREIGN PATENT DOCUMENTS

AT 141398 8/1996
AU 2005203363 2/2006
(Continued)

OTHER PUBLICATIONS

Extended European Search Report, EP 17810773.6, dated Apr. 5, 2020.

(Continued)

*Primary Examiner* — Benjamin R Shaw
(74) *Attorney, Agent, or Firm* — Boyle Fredrickson, S.C.

(57) ABSTRACT

A lavatory drain system is disclosed. The basin, containing a U-shaped drain channel, employs one of two draining embodiments. In the first, a drain plate divides the drain channel into two chambers, allowing for fluid communication between them through openings in the drain plate. In another embodiment, the drain channel forms the upper chamber while a pipe disposed below the channel serves as a lower chamber for fluid to flow to the drain. Further, the drain cap of the claimed system is configured to direct air about the basin. One embodiment utilizes a ridge protruding over one of the basin's sides to captures air and directs it to a return duct. In the other embodiment, a series of louvres located in an opening are used to filter water and debris from the air before it returns to the fan.

20 Claims, 21 Drawing Sheets

Related U.S. Application Data which is a continuation-in-part of application No. 15/176,406, filed on Jun. 8, 2016, now Pat. No. 10,041,236.

(58) Field of Classification Search
USPC ..... 4/628, 679
See application file for complete search history.

(56) References Cited

U.S. PATENT DOCUMENTS

D36,574 S 2/1899 Zipp
D36,575 S 10/1903 Zipp
D36,595 S 10/1903 Peet
937,509 A 10/1909 Carpenter
1,069,972 A 6/1913 Metzaer
1,323,398 A 12/1919 Leland
1,419,712 A 6/1922 Bassette
1,423,800 A 7/1922 Hibbard et al.
1,494,883 A 5/1924 Bassette et al.
1,578,047 A 3/1926 Lum
1,579,705 A 4/1926 Hewitt
1,616,313 A 2/1927 Farmer
1,659,851 A 2/1928 Brewington
1,750,094 A 3/1930 Emmrich
1,765,915 A 6/1930 Haase
D81,754 S 8/1930 Mabee
1,816,055 A 7/1931 Pfeifer
1,961,179 A 6/1934 Tinkham
1,997,387 A 4/1935 McCord
2,008,183 A 7/1935 McCord
2,027,605 A 5/1936 McCord et al.
2,041,352 A 5/1936 Jordan
D100,310 S 7/1936 Blu
2,130,196 A 9/1938 Sakier
2,192,383 A 3/1940 Krolop
2,202,107 A 5/1940 Korn
2,281,370 A 4/1942 Morrison et al.
2,328,129 A 8/1943 Earle
2,438,762 A 3/1948 McLeckie
2,470,187 A 5/1949 Price
2,479,571 A 8/1949 Hewitt
2,498,699 A 2/1950 Mullett et al.
2,504,740 A 4/1950 Siegel
2,521,769 A 9/1950 Arcularius
2,537,821 A 1/1951 Fodor
2,591,669 A 4/1952 Bucknell et al.
2,606,274 A 8/1952 Spierer
RE23,674 E 6/1953 Spierer et al.
2,641,679 A 6/1953 Brodbeck
2,646,629 A 7/1953 Clemens
D170,204 S 8/1953 Long
2,651,705 A 9/1953 Clemens
2,666,837 A 1/1954 Brodbeck
2,677,041 A 4/1954 Oliver et al.
2,698,894 A 1/1955 Stein
2,714,151 A 7/1955 Becker
2,761,222 A 9/1956 Bennett
2,767,407 A 10/1956 Weiss
2,777,934 A 1/1957 Falkenthal
2,826,763 A 3/1958 Bass
2,837,835 A 6/1958 Hewitt et al.
2,847,681 A * 8/1958 Jacobs ..... E03C 1/182 4/653
2,853,591 A 9/1958 Fine
2,853,592 A 9/1958 Gravet
2,859,535 A 11/1958 Carlson
2,906,627 A 9/1959 Payton et al.
2,908,019 A 10/1959 Lyon, Jr.
2,965,906 A 12/1960 Mullett et al.
2,977,455 A 3/1961 Murphy
3,059,815 A 10/1962 Parsons, Jr.
3,065,473 A 11/1962 Sporck et al.
3,076,887 A 2/1963 Bulow
3,128,161 A 4/1964 Hudon
D201,493 S 6/1965 Sundberg et al.
3,220,424 A 11/1965 Nelson
3,305,938 A 2/1967 Arthur
D210,131 S 2/1968 Rourke
3,384,977 A 5/1968 Rosenberg
3,409,995 A 11/1968 Greenwood et al.
3,415,278 A 12/1968 Yamamoto et al.
3,449,838 A 6/1969 Chancellor
3,480,787 A 11/1969 Johansen
3,487,477 A 1/1970 Classen
3,491,381 A 1/1970 Catheart
3,502,384 A 3/1970 Gipson
3,505,692 A 4/1970 Forbes
3,523,305 A 8/1970 Zorn
3,536,294 A 10/1970 Rodriguez
3,551,919 A 1/1971 Forbes
3,556,158 A 1/1971 Schneider
3,575,583 A 4/1971 Brown
3,575,640 A 4/1971 Ishikawa
3,576,277 A 4/1971 Blackman
3,585,652 A 6/1971 Forbes et al.
3,585,653 A 6/1971 Forbes et al.
3,587,177 A 6/1971 Overly et al.
3,588,038 A 6/1971 Tanaka
3,603,002 A 9/1971 Spierer
3,613,124 A 10/1971 Ichimori et al.
3,621,199 A 11/1971 Goldstein
3,639,920 A 2/1972 Griffin et al.
3,643,346 A 2/1972 Lester
3,699,984 A 10/1972 Davis
3,724,001 A 4/1973 Ichimori et al.
3,728,745 A * 4/1973 Brendgord ..... A47K 1/04 4/624
3,744,149 A 7/1973 Helbling
3,746,035 A 7/1973 Singer
3,757,806 A 9/1973 Bhaskar et al.
3,817,651 A 6/1974 Law et al.
3,878,621 A 4/1975 Duerre
3,904,167 A 9/1975 Touch et al.
3,906,795 A 9/1975 Kask
3,918,987 A 11/1975 Kopfer
D238,075 S 12/1975 Harris
3,975,781 A 8/1976 Klimboff et al.
3,992,730 A * 11/1976 Davis ..... A61B 90/80 4/624
4,072,157 A 2/1978 Wines, Jr. et al.
4,087,925 A 5/1978 Bienek
4,120,180 A 10/1978 Jedora
4,144,596 A 3/1979 MacFarlane et al.
4,145,602 A 3/1979 Lee
4,145,769 A 3/1979 MacFarlane et al.
D251,795 S 5/1979 McCann
4,193,209 A 3/1980 Lovison et al.
4,195,416 A 4/1980 Hall
4,219,367 A 8/1980 Cary, Jr. et al.
4,239,555 A 12/1980 Scharlack et al.
4,256,133 A 3/1981 Coward et al.
D260,678 S 9/1981 Hiller
4,295,233 A 10/1981 Hinkel et al.
4,309,781 A 1/1982 Lissau
4,336,619 A 6/1982 Hinkel et al.
4,375,874 A 3/1983 Leotta et al.
4,383,377 A 5/1983 Crafton
4,398,310 A 8/1983 Lienhard
4,402,095 A 9/1983 Pepper
4,402,331 A 9/1983 Taldo et al.
D272,263 S 1/1984 Lienhard
4,429,422 A 2/1984 Warcham
4,453,286 A 6/1984 Wieland
4,461,439 A 7/1984 Rose
4,497,999 A 2/1985 Postbeschild
4,509,543 A 4/1985 Livingston et al.
D279,404 S 6/1985 Hiller
4,520,516 A 6/1985 Parsons
4,541,563 A 9/1985 Uetsuhara
4,570,823 A 2/1986 Arabian et al.
4,594,797 A 6/1986 Houck, Jr.
4,598,726 A 7/1986 Pepper
4,604,764 A 8/1986 Enzo
4,606,085 A 8/1986 Davies

(56) References Cited

U.S. PATENT DOCUMENTS 4,610,165 A 9/1986 Duffy et al.
4,611,768 A 9/1986 Voss et al.
4,624,017 A 11/1986 Foletta
4,637,254 A 1/1987 Dyben et al.
4,642,821 A 2/1987 Zanuso et al.
4,642,909 A 2/1987 Garcial
4,644,256 A 2/1987 Farias et al.
4,653,201 A 3/1987 Seaman
4,670,010 A 6/1987 Dragone
4,671,121 A 6/1987 Schieler
4,681,141 A 7/1987 Wang
4,682,628 A 7/1987 Hill
4,685,222 A 8/1987 Houck, Jr.
4,688,277 A 8/1987 Kakinoki et al.
4,688,585 A 8/1987 Vetter
4,700,049 A 10/1987 Rubin
4,702,107 A 10/1987 Guerrini et al.
4,707,867 A 11/1987 Kawabe et al.
4,707,933 A 11/1987 Keck et al.
4,709,728 A 12/1987 Ying-Chung
4,716,605 A 1/1988 Shepherd et al.
4,722,372 A 2/1988 Hoffman et al.
4,735,002 A 4/1988 Rath
4,735,357 A 4/1988 Gregory et al.
4,741,363 A 5/1988 Hu
4,742,583 A 5/1988 Yoshida et al.
4,742,836 A 5/1988 Buehler
4,744,515 A 5/1988 Watanabe
4,746,090 A 5/1988 Hamilton
4,762,273 A 8/1988 Gregory et al.
4,765,003 A 8/1988 Chang
4,767,922 A 8/1988 Stauffer
4,769,863 A 9/1988 Tegg et al.
4,780,595 A 10/1988 Alban
4,785,162 A 11/1988 Kuo
4,823,414 A 4/1989 Piersimoni et al.
4,826,129 A 5/1989 Fong et al.
4,839,039 A 6/1989 Parsons et al.
4,848,599 A 7/1989 Kano et al.
4,852,802 A 8/1989 Iggulden et al.
4,856,122 A 8/1989 Pilolla
4,857,112 A 8/1989 Franninge
4,857,705 A 8/1989 Blevins
4,872,485 A 10/1989 Laverty, Jr.
4,876,435 A 10/1989 Hawkins
4,882,467 A 11/1989 Dimick
4,883,749 A 11/1989 Roberts et al.
4,889,315 A 12/1989 Imanaga
4,894,874 A 1/1990 Wilson
4,909,580 A 3/1990 Mitchell
4,914,758 A 4/1990 Shaw
4,914,833 A 4/1990 Pilolla et al.
4,915,347 A 4/1990 Iqbal et al.
4,916,382 A 4/1990 Kent
4,916,613 A 4/1990 Lange et al.
4,921,129 A 5/1990 Jones et al.
4,921,131 A 5/1990 Binderbauer et al.
4,921,211 A 5/1990 Novak et al.
4,940,298 A 7/1990 Jackson et al.
4,941,219 A 7/1990 Van Marcke
4,942,631 A 7/1990 Rosa
4,948,090 A 8/1990 Chen
4,953,236 A 9/1990 Lee et al.
4,954,179 A 9/1990 Franninge
4,955,535 A 9/1990 Tsutsui et al.
4,959,603 A 9/1990 Yamamoto et al.
4,963,780 A 10/1990 Hochstrasser
4,967,425 A 11/1990 Kawamura et al.
4,971,106 A 11/1990 Tsutsui et al.
4,980,474 A 12/1990 Hayashi et al.
4,980,574 A 12/1990 Cirrito
4,984,314 A 1/1991 Weigert
4,986,221 A 1/1991 Shaw
4,989,755 A 2/1991 Shiau
4,995,585 A 2/1991 Gruber et al.
4,998,673 A 3/1991 Pilolla
5,000,044 A 3/1991 Duffy et al.
5,008,963 A 4/1991 Stein
5,018,550 A 5/1991 Burdorff
5,025,516 A 6/1991 Wilson
5,031,258 A 7/1991 Shaw
5,031,337 A 7/1991 Pilolla et al.
5,033,508 A 7/1991 Laverty, Jr.
5,033,715 A 7/1991 Chiang et al.
5,060,323 A 10/1991 Shaw
5,062,164 A 11/1991 Lee et al.
5,063,622 A 11/1991 Tsutsui et al.
5,063,955 A 11/1991 Sakakibara
5,072,618 A 12/1991 Taylor et al.
5,074,322 A 12/1991 Jaw
5,074,520 A 12/1991 Lee et al.
5,076,424 A 12/1991 Nakamura
5,080,324 A 1/1992 Chi
RE33,810 E 2/1992 Strieter
5,084,984 A 2/1992 Duchoud et al.
5,086,526 A 2/1992 Van Marcke
5,092,560 A 3/1992 Chen
5,095,941 A 3/1992 Betz
5,099,587 A 3/1992 Jarosch
5,111,594 A 5/1992 Allen
D326,711 S 6/1992 Lotito et al.
5,117,693 A 6/1992 Duksa
5,131,428 A 7/1992 Bory
5,133,095 A 7/1992 Shiba et al.
5,144,757 A 9/1992 Sasso
5,146,695 A 9/1992 Yang
5,158,114 A 10/1992 Botsolas
5,163,234 A 11/1992 Tsukamoto et al.
5,169,118 A 12/1992 Whiteside
5,170,944 A 12/1992 Shirai
D332,194 S 1/1993 Hines
D332,195 S 1/1993 Hines
D332,196 S 1/1993 Hines
D332,365 S 1/1993 Hines
D332,366 S 1/1993 Hines
D332,369 S 1/1993 Henna et al.
D332,370 S 1/1993 Hanna et al.
D332,542 S 1/1993 Hines
D332,679 S 1/1993 Hines
D332,849 S 1/1993 Hines
5,175,892 A 1/1993 Shaw
5,177,879 A 1/1993 Muta
5,181,328 A 1/1993 Bouverie
D332,889 S 2/1993 Hines
5,184,642 A 2/1993 Powell
5,186,360 A 2/1993 Mease et al.
D334,266 S 3/1993 Hines
5,193,563 A 3/1993 Melech
5,199,116 A 4/1993 Fischer
5,199,118 A 4/1993 Cole et al.
5,199,188 A 4/1993 Franz
5,202,666 A 4/1993 Knippscheer
D336,572 S 6/1993 Gunderson et al.
5,216,251 A 6/1993 Matschke
5,217,035 A 6/1993 Van Marcke
5,224,685 A 7/1993 Chiang et al.
5,226,629 A 7/1993 Millman et al.
5,230,109 A 7/1993 Zaccai et al.
D338,361 S 8/1993 Hines
5,239,610 A 8/1993 Shao
5,243,717 A 9/1993 Yasuo
D340,374 S 10/1993 Hines
D340,375 S 10/1993 Hines
5,251,872 A 10/1993 Kodaira
5,253,376 A 10/1993 Fait
5,255,822 A 10/1993 Mease et al.
D341,724 S 11/1993 Hines
5,257,423 A 11/1993 Jacobsen et al.
5,259,410 A 11/1993 Trueb et al.
5,265,288 A 11/1993 Allison
5,265,628 A 11/1993 Sage et al.
D342,175 S 12/1993 Hines
D342,177 S 12/1993 Hanna et al.
5,267,475 A 12/1993 Gaston

(56) References Cited

U.S. PATENT DOCUMENTS 5,269,071 A 12/1993 Hamabe et al.
5,272,918 A 12/1993 Gaston et al.
D342,992 S 1/1994 Robertson
5,280,679 A 1/1994 Edelman
D344,830 S 3/1994 Carter et al.
5,341,839 A 8/1994 Kobayashi et al.
5,347,864 A 9/1994 Senghaas et al.
5,351,347 A 10/1994 Kunkel
5,351,417 A 10/1994 Rubin
5,362,026 A 11/1994 Kobayashi et al.
5,363,517 A 11/1994 Botsolas
5,367,442 A 11/1994 Frost et al.
5,369,818 A 12/1994 Barnum et al.
5,377,424 A 1/1995 Albanes
5,377,427 A 1/1995 Mashata
D355,949 S 2/1995 Laughton
5,397,099 A 3/1995 Pilolla
5,404,419 A 4/1995 Artis, Jr.
5,412,816 A 5/1995 Paterson et al.
5,412,818 A 5/1995 Chen
5,426,271 A 6/1995 Clark et al.
D361,372 S 8/1995 Enthoven
5,438,714 A 8/1995 Shaw
5,438,763 A 8/1995 Yang
5,442,867 A 8/1995 Robinson
D362,901 S 10/1995 Dannenberg et al.
5,458,147 A 10/1995 Mauerhofer
5,459,944 A 10/1995 Tatsutani et al.
D364,675 S 11/1995 Tebbe
5,477,984 A 12/1995 Sayama et al.
5,482,250 A 1/1996 Kodaira
5,497,135 A 3/1996 Wisskirchen et al.
5,504,950 A 4/1996 Natalizia et al.
5,514,346 A 5/1996 Fujita
5,522,411 A 6/1996 Johnson
5,548,119 A 8/1996 Nortier
5,555,912 A 9/1996 Saadi et al.
5,561,871 A 10/1996 Laughton
5,566,404 A 10/1996 Laughton
5,566,702 A 10/1996 Philipp
5,570,869 A 11/1996 Diaz et al.
5,586,746 A 12/1996 Humpert et al.
5,588,636 A 12/1996 Eichholz et al.
5,595,216 A 1/1997 Pilolla
5,610,591 A 3/1997 Gallagher
5,611,093 A 3/1997 Barnum et al.
5,611,517 A 3/1997 Saadi et al.
5,625,908 A 5/1997 Shaw
5,627,375 A 5/1997 Hsieh
5,640,781 A 6/1997 Carson
5,642,462 A 6/1997 Huff
D380,529 S 7/1997 Laughton
5,651,189 A 7/1997 Coykendall
5,651,384 A 7/1997 Rudrich
5,670,945 A 9/1997 Applonie
D387,144 S 12/1997 Flaherty
5,699,833 A 12/1997 Tsataros
5,701,929 A 12/1997 Helmsderfer
5,727,579 A 3/1998 Chardack
5,730,165 A 3/1998 Philipp
D393,700 S 4/1998 Trueb et al.
5,743,511 A 4/1998 Eichholz et al.
D394,495 S 5/1998 Hauser
5,758,688 A 6/1998 Hamanaka et al.
5,765,242 A 6/1998 Marciano
5,769,120 A 6/1998 Laverty, Jr. et al.
5,781,942 A 7/1998 Allen et al.
5,782,382 A 7/1998 Van Marcke
D398,969 S 9/1998 Hauser, II
5,813,047 A 9/1998 Teichroeb
5,819,335 A 10/1998 Hennessy
5,819,336 A 10/1998 Gilliam et al.
5,829,072 A 11/1998 Hirsch et al.
D402,358 S 12/1998 Bonnell
5,855,356 A 1/1999 Fait
5,868,311 A 2/1999 Cretu-Petra
5,873,178 A 2/1999 Johnson
5,875,562 A 3/1999 Fogarty
5,893,387 A 4/1999 Paterson et al.
5,915,417 A 6/1999 Diaz et al.
5,915,851 A 6/1999 Wattrick et al.
D411,876 S 7/1999 Hafner et al.
5,918,855 A 7/1999 Hamanaka et al.
5,924,148 A 7/1999 Flowers, Sr.
5,943,712 A 8/1999 Van Marcke
5,943,713 A 8/1999 Paterson et al.
5,945,068 A 8/1999 Ferone
5,945,913 A 8/1999 Gallagher
5,950,983 A 9/1999 Jahrling
5,954,069 A 9/1999 Foster
5,961,095 A 10/1999 Schrott
5,966,753 A 10/1999 Gauthier et al.
5,972,126 A 10/1999 Fernie
5,974,685 A 11/1999 Hironaka
5,979,500 A 11/1999 Jahrling et al.
5,984,262 A 11/1999 Parsons et al.
5,988,588 A 11/1999 Allen et al.
5,992,430 A 11/1999 Chardack et al.
6,000,429 A 12/1999 Van Marcke
6,003,170 A 12/1999 Humpert et al.
6,006,388 A 12/1999 Young
6,006,784 A 12/1999 Tsutsui et al.
D420,727 S 2/2000 Hundley
6,018,885 A 2/2000 Hill
6,029,292 A 2/2000 Leiferman et al.
6,029,293 A 2/2000 Paterson et al.
6,038,786 A 3/2000 Aisenberg et al.
D422,346 S 4/2000 Svendsen
6,056,261 A 5/2000 Aparicio et al.
6,059,192 A 5/2000 Zosimadis
6,067,673 A 5/2000 Paese et al.
D428,477 S 7/2000 O'Connell et al.
6,082,407 A 7/2000 Paterson et al.
6,088,842 A * 7/2000 Barnett ..... E04H 4/1236 4/286
6,089,086 A 7/2000 Swindler et al.
6,110,292 A 8/2000 Jewett et al.
D431,288 S 9/2000 Helmsderfer
6,119,285 A 9/2000 Kim
D433,109 S 10/2000 Wilke et al.
6,125,482 A 10/2000 Foster
6,127,671 A 10/2000 Parsons et al.
6,128,826 A 10/2000 Robinson
6,131,587 A 10/2000 Chardack et al.
6,142,342 A 11/2000 Lewis
6,161,227 A 12/2000 Bargenquast
6,161,814 A 12/2000 Jahrling
D435,893 S 1/2001 Helmsderfer
6,178,572 B1 1/2001 Van Marcke
6,185,838 B1 2/2001 Moore
6,189,163 B1 2/2001 Van Marcke
6,189,230 B1 2/2001 Huen
6,192,530 B1 2/2001 Dai
6,199,428 B1 3/2001 Estevez-Garcia et al.
6,202,980 B1 3/2001 Vincent et al.
6,206,340 B1 3/2001 Paese et al.
6,209,392 B1 4/2001 Rapala
6,212,707 B1 4/2001 Thompson et al.
6,215,116 B1 4/2001 Van Marcke
6,216,534 B1 4/2001 Ross, Jr. et al.
6,219,857 B1 4/2001 Wu
6,219,859 B1 4/2001 Derakhshan
6,236,317 B1 5/2001 Cohen et al.
6,250,601 B1 6/2001 Kolar et al.
6,253,609 B1 7/2001 Ross, Jr. et al.
6,253,611 B1 7/2001 Varga et al.
6,257,264 B1 7/2001 Sturman et al.
6,267,007 B1 7/2001 Gunther
D446,664 S 8/2001 Petri
D447,224 S 8/2001 Hauser, II
6,269,695 B1 8/2001 Cesternino et al.
6,273,394 B1 8/2001 Vincent et al.
6,279,179 B1 8/2001 Register
6,279,587 B1 8/2001 Yamamoto

(56) References Cited

U.S. PATENT DOCUMENTS

| | | | |
|---|---|---|---|
| 6,282,812 | B1 | 9/2001 | Wee et al. |
| 6,286,153 | B1 | 9/2001 | Keller |
| 6,289,728 | B1 | 9/2001 | Wilkins |
| 6,294,786 | B1 | 9/2001 | Marcichow et al. |
| 6,295,410 | B1 | 9/2001 | Helms et al. |
| D448,585 | S | 10/2001 | Petri |
| 6,298,502 | B1 | 10/2001 | Brown |
| 6,317,717 | B1 | 11/2001 | Lindsey et al. |
| 6,321,785 | B1 | 11/2001 | Bergmann |
| 6,322,005 | B1 | 11/2001 | Kern et al. |
| 6,340,032 | B1 | 1/2002 | Zosimadis |
| 6,341,389 | B2 | 1/2002 | Philipps-Libeich et al. |
| D453,882 | S | 2/2002 | Petri |
| 6,349,484 | B1 | 2/2002 | Cohen |
| 6,351,866 | B1 | 3/2002 | Bragulla |
| 6,363,549 | B2 | 4/2002 | Humpert et al. |
| 6,370,951 | B1 | 4/2002 | Kerchaert et al. |
| 6,386,390 | B1 | 5/2002 | Tinker |
| 6,390,125 | B2 | 5/2002 | Pawelzik et al. |
| 6,393,634 | B1 | 5/2002 | Kodaira et al. |
| 6,401,274 | B1 | 6/2002 | Brown |
| 6,408,881 | B2 | 6/2002 | Lorenzelli et al. |
| 6,418,788 | B2 | 7/2002 | Articolo |
| 6,426,701 | B1 | 7/2002 | Levy et al. |
| 6,431,189 | B1 | 8/2002 | Deibert |
| D462,195 | S | 9/2002 | Wang |
| RE37,888 | E | 10/2002 | Cretu-Petra |
| 6,467,514 | B1 | 10/2002 | Korst et al. |
| 6,467,651 | B1 | 10/2002 | Muderlak et al. |
| 6,481,040 | B1 | 11/2002 | McIntyre |
| 6,481,634 | B1 | 11/2002 | Zosimadis |
| 6,484,965 | B1 | 11/2002 | Reaves |
| 6,508,121 | B2 | 1/2003 | Eck |
| 6,523,193 | B2 | 2/2003 | Saraya |
| 6,523,404 | B1 | 2/2003 | Murphy et al. |
| 6,568,655 | B2 | 5/2003 | Paese et al. |
| 6,572,207 | B2 | 6/2003 | Hase et al. |
| D477,060 | S | 7/2003 | Loberger et al. |
| 6,598,245 | B2 | 7/2003 | Nishioka |
| 6,619,320 | B2 | 9/2003 | Parsons |
| 6,624,606 | B2 | 9/2003 | Kushida et al. |
| 6,639,209 | B1 | 10/2003 | Patterson et al. |
| D481,826 | S | 11/2003 | Martinuzzo et al. |
| 6,641,002 | B2 | 11/2003 | Gerenraich et al. |
| 6,643,865 | B2 | 11/2003 | Bork et al. |
| 6,651,851 | B2 | 11/2003 | Muderlak et al. |
| D483,152 | S | 12/2003 | Martinuzzo et al. |
| 6,658,934 | B1 | 12/2003 | Housey et al. |
| D484,958 | S | 1/2004 | Loberger et al. |
| 6,671,890 | B2 | 1/2004 | Nishioka |
| 6,671,898 | B1 | 1/2004 | Eggenberger et al. |
| 6,679,285 | B2 | 1/2004 | Pablo |
| 6,691,340 | B2 | 2/2004 | Honda et al. |
| 6,691,724 | B2 | 2/2004 | Ford |
| 6,711,949 | B1 | 3/2004 | Sorenson |
| 6,711,950 | B1 | 3/2004 | Yamaura et al. |
| 6,715,730 | B2 | 4/2004 | Ehr |
| 6,766,589 | B1 | 7/2004 | Bory et al. |
| 6,769,197 | B1 | 8/2004 | Tai |
| 6,769,443 | B2 | 8/2004 | Bush |
| 6,770,869 | B2 | 8/2004 | Patterson et al. |
| D496,450 | S | 9/2004 | Loberger et al. |
| 6,789,197 | B1 | 9/2004 | Saito |
| 6,812,657 | B2 | 11/2004 | Mario |
| 6,827,294 | B1 | 12/2004 | Fan et al. |
| 6,843,079 | B2 | 1/2005 | Hird |
| 6,857,314 | B2 | 2/2005 | Ohhashi et al. |
| 6,871,541 | B2 | 3/2005 | Weisse |
| 6,882,278 | B2 | 4/2005 | Winings et al. |
| 6,883,563 | B2 | 4/2005 | Smith |
| D507,634 | S | 7/2005 | Loberger et al. |
| 6,912,864 | B2 | 7/2005 | Roche et al. |
| 6,915,690 | B2 | 7/2005 | Okada et al. |
| 6,922,144 | B2 | 7/2005 | Bulin et al. |
| D508,117 | S | 8/2005 | Loberger et al. |
| 6,922,912 | B2 | 8/2005 | Phillips |
| 6,928,235 | B2 | 8/2005 | Pollack |
| 6,929,150 | B2 | 8/2005 | Muderlak et al. |
| D509,577 | S | 9/2005 | Loberger et al. |
| 6,950,606 | B2 | 9/2005 | Logan et al. |
| D511,205 | S | 11/2005 | Loberger et al. |
| D511,821 | S | 11/2005 | Loberger et al. |
| 6,962,005 | B1 | 11/2005 | Khosropour et al. |
| 6,962,168 | B2 | 11/2005 | McDaniel et al. |
| 6,964,405 | B2 | 11/2005 | Marcichow et al. |
| 6,966,334 | B2 | 11/2005 | Bolster |
| 6,968,860 | B1 | 11/2005 | Haenlein et al. |
| D512,648 | S | 12/2005 | Smith et al. |
| 6,980,126 | B2 | 12/2005 | Fournier |
| 6,986,171 | B1 | 1/2006 | Perrin |
| 6,993,968 | B2 | 2/2006 | Kogure |
| 6,996,863 | B2 | 2/2006 | Kaneko |
| 7,007,318 | B1 | 3/2006 | Bork et al. |
| 7,014,166 | B1 | 3/2006 | Wang |
| 7,018,473 | B2 | 3/2006 | Shadrach, III |
| 7,025,227 | B2 | 4/2006 | Oliver et al. |
| 7,039,301 | B1 | 5/2006 | Aisenberg et al. |
| 7,039,963 | B2 | 5/2006 | Loberger et al. |
| 7,079,037 | B2 | 7/2006 | Ross, Jr. et al. |
| D526,394 | S | 8/2006 | Loberger et al. |
| D527,085 | S | 8/2006 | Loberger et al. |
| 7,082,828 | B1 | 8/2006 | Wilkins |
| 7,093,485 | B2 | 8/2006 | Newman et al. |
| D527,809 | S | 9/2006 | Loberger et al. |
| 7,104,519 | B2 | 9/2006 | O'Maley et al. |
| 7,107,631 | B2 | 9/2006 | Lang et al. |
| 7,114,510 | B2 | 10/2006 | Peters et al. |
| 7,150,293 | B2 | 12/2006 | Jonte |
| 7,165,450 | B2 | 1/2007 | Jamnia et al. |
| 7,174,577 | B2 | 2/2007 | Jost et al. |
| D537,927 | S | 3/2007 | Loberger et al. |
| D538,898 | S | 3/2007 | Trepanier |
| D539,400 | S | 3/2007 | Loberger et al. |
| 7,191,484 | B2 | 3/2007 | Dawe |
| 7,191,920 | B2 | 3/2007 | Boll et al. |
| 7,198,175 | B2 | 4/2007 | Opharcit |
| 7,201,052 | B2 | 4/2007 | Lee |
| D542,474 | S | 5/2007 | Churchill et al. |
| 7,219,686 | B2 | 5/2007 | Schmitz et al. |
| 7,228,874 | B2 | 6/2007 | Bolderheij et al. |
| 7,228,984 | B2 | 6/2007 | Tack et al. |
| 7,232,111 | B2 | 6/2007 | McDaniel et al. |
| 7,242,307 | B1 | 7/2007 | LeBlond et al. |
| 7,269,864 | B2 | 9/2007 | Brown et al. |
| 7,271,728 | B2 | 9/2007 | Taylor et al. |
| 7,278,624 | B2 | 10/2007 | Iott et al. |
| 7,296,765 | B2 | 11/2007 | Rodrain |
| 7,305,722 | B2 | 12/2007 | Sha et al. |
| 7,315,165 | B2 | 1/2008 | Kleinen et al. |
| 7,318,949 | B2 | 1/2008 | Shadrach, III |
| 7,320,146 | B2 | 1/2008 | Nortier et al. |
| D561,315 | S | 2/2008 | Loberger et al. |
| 7,343,799 | B2 | 3/2008 | Nagakura et al. |
| 7,350,245 | B2 | 4/2008 | Giagni |
| 7,375,656 | B2 | 5/2008 | Muller et al. |
| 7,377,163 | B2 | 5/2008 | Miyagawa |
| 7,396,000 | B2 | 7/2008 | Parsons et al. |
| 7,406,722 | B2 | 8/2008 | Fukuizurni et al. |
| 7,409,860 | B2 | 8/2008 | Ferreira et al. |
| 7,437,833 | B2 | 10/2008 | Sato et al. |
| 7,443,305 | B2 | 10/2008 | Verdiramo |
| 7,451,894 | B2 | 11/2008 | Ophardt |
| 7,455,197 | B2 | 11/2008 | Ophardt |
| 7,458,261 | B2 | 12/2008 | Miyagawa |
| 7,464,418 | B2 | 12/2008 | Seggio et al. |
| 7,467,550 | B2 | 12/2008 | Betz, II et al. |
| 7,471,883 | B2 | 12/2008 | Seutter et al. |
| 7,472,433 | B2 | 1/2009 | Rodenbeck et al. |
| 7,477,148 | B2 | 1/2009 | Lynn et al. |
| 7,484,409 | B2 | 2/2009 | Dykstra et al. |
| D588,676 | S | 3/2009 | Loberger et al. |
| 7,516,939 | B2 | 4/2009 | Bailey |
| D591,839 | S | 5/2009 | Loberger et al. |
| 7,527,174 | B2 | 5/2009 | Meehan et al. |

(56) References Cited

U.S. PATENT DOCUMENTS 7,530,269 B2 5/2009 Newman et al.
7,533,787 B2 5/2009 Muderiak et al.
7,537,195 B2 5/2009 McDaniel et al.
7,555,209 B2 6/2009 Pradas Diez et al.
D599,059 S 8/2009 Clerch
7,588,168 B2 9/2009 Bagwell et al.
7,596,883 B2 10/2009 Kameishi
7,597,122 B1 10/2009 Smith
7,607,442 B2 10/2009 Barnhill et al.
7,607,443 B2 10/2009 Barnhill et al.
7,614,096 B2 11/2009 Vincent
7,614,160 B2 11/2009 Kameishi et al.
7,617,830 B2 11/2009 Barnhill et al.
7,627,909 B2 12/2009 Esche
7,631,372 B2 12/2009 Marty et al.
7,641,173 B2 1/2010 Goodman
7,641,740 B2 1/2010 Barnhill et al.
7,650,653 B2 1/2010 Johnson et al.
7,651,068 B2 1/2010 Bailey
D610,242 S 2/2010 Loberger et al.
7,657,162 B2 2/2010 Itoigawa et al.
7,659,824 B2 2/2010 Prodanovich et al.
7,681,447 B2 3/2010 Nagakura et al.
7,682,464 B2 3/2010 Glenn et al.
D614,273 S 4/2010 Loberger et al.
7,690,395 B2 4/2010 Jonte et al.
7,690,623 B2 4/2010 Parsons et al.
7,698,770 B2 4/2010 Barnhill et al.
7,701,164 B2 4/2010 Clothier et al.
7,721,602 B2 5/2010 Benner et al.
7,726,334 B2 6/2010 Ross, Jr. et al.
7,731,154 B2 6/2010 Parsons et al.
7,743,438 B2 6/2010 Chen
7,743,782 B2 6/2010 Jost
7,750,594 B2 7/2010 Clothier et al.
7,754,021 B2 7/2010 Barnhill et al.
7,754,022 B2 7/2010 Barnhill et al.
7,757,700 B2 7/2010 Barnhill et al.
7,758,701 B2 7/2010 Barnhill et al.
7,766,026 B2 8/2010 Boey
7,766,043 B2 8/2010 Thomas et al.
7,766,194 B2 8/2010 Boll et al.
7,774,953 B1 8/2010 Duran
7,784,481 B2 8/2010 Kunkel
7,786,628 B2 8/2010 Childe et al.
7,789,095 B2 9/2010 Barnhill et al.
7,797,769 B2 9/2010 Ozenick
7,804,409 B2 9/2010 Munro et al.
D625,792 S 10/2010 Rundberg et al.
7,812,598 B2 10/2010 Yasuda et al.
7,814,582 B2 10/2010 Reddy et al.
7,815,134 B2 10/2010 Hohl
7,818,083 B2 10/2010 Glenn et al.
7,819,136 B1 10/2010 Eddy
D628,280 S 11/2010 Loberger et al.
7,825,564 B2 11/2010 Croft et al.
RE42,005 E 12/2010 Jost et al.
D629,877 S 12/2010 Rundberg et al.
7,856,736 B2 12/2010 Churchill et al.
7,860,671 B1 12/2010 LaCaze
D633,992 S 3/2011 Rundberg et al.
D637,350 S 5/2011 Kato et al.
7,944,116 B2 5/2011 Causier
7,946,055 B2 5/2011 Churchill et al.
7,971,368 B2 7/2011 Fukaya et al.
8,037,619 B2 10/2011 Liu
8,043,714 B2 10/2011 Hashimoto
8,064,756 B2 11/2011 Liu
8,104,512 B2 1/2012 Nelson et al.
8,128,465 B2 3/2012 Collins
8,136,262 B2 3/2012 Collins
D661,023 S 5/2012 Liu et al.
8,201,344 B2 6/2012 Sawabe et al.
8,382,065 B2 2/2013 Hendrickson et al.
8,408,517 B2 4/2013 Jonte et al.
8,474,068 B2 * 7/2013 Kik, Sr. ..... E03F 5/0408 4/613
8,487,235 B2 7/2013 Wang et al.
8,813,383 B2 8/2014 Liu et al.
9,062,440 B2 6/2015 Denzler et al.
9,157,223 B2 * 10/2015 Kempen ..... E03C 1/24
9,226,624 B2 1/2016 Bem et al.
9,334,638 B1 * 5/2016 Kirby ..... E03F 3/046
D768,824 S 10/2016 Murray et al.
9,486,118 B2 11/2016 Courtney et al.
9,518,681 B2 12/2016 Williamson
9,562,721 B2 2/2017 Muderlak et al.
9,611,634 B2 * 4/2017 Erlebach ..... E03F 5/0408
D785,760 S 5/2017 Murray et al.
D785,761 S 5/2017 Murray et al.
9,743,812 B2 8/2017 Courtney
9,758,953 B2 9/2017 Bayley et al.
D811,535 S 2/2018 Wieser et al.
D813,360 S 5/2018 Murray et al.
9,982,422 B2 5/2018 Courtney et al.
D820,404 S 6/2018 Wieser et al.
D820,405 S 6/2018 Wieser et al.
D820,406 S 6/2018 Wieser et al.
D820,407 S 6/2018 Wieser et al.
D820,408 S 6/2018 Murray et al.
9,995,025 B2 6/2018 Wang et al.
D823,997 S 7/2018 Murray et al.
10,030,371 B2 7/2018 Ciavarella et al.
10,081,931 B2 9/2018 Song
10,087,608 B2 10/2018 Dobizl et al.
D839,389 S 1/2019 Wieser et al.
10,246,859 B1 * 4/2019 Hsu ..... A47K 5/1217
10,428,498 B1 10/2019 Montague
2002/0019709 A1 2/2002 Segal
2002/0157176 A1 10/2002 Wawrla et al.
2003/0046758 A1 * 3/2003 Gerloff ..... E03C 1/18 4/619
2003/0172547 A1 9/2003 Shepard
2003/0210140 A1 11/2003 Menard et al.
2004/0025248 A1 2/2004 Lang et al.
2004/0083547 A1 5/2004 Mercier
2004/0128755 A1 7/2004 Loberger et al.
2004/0129075 A1 7/2004 Sorenson
2004/0143898 A1 7/2004 Jost et al.
2004/0149779 A1 8/2004 Boll et al.
2004/0182151 A1 9/2004 Meure
2004/0221645 A1 11/2004 Brzozowski et al.
2004/0221646 A1 11/2004 Ohhashi et al.
2004/0221647 A1 11/2004 Sabatino
2004/0238660 A1 12/2004 Fan et al.
2005/0000015 A1 1/2005 Kaneko
2005/0087557 A1 4/2005 Oliver et al.
2005/0098968 A1 5/2005 Dyson et al.
2005/0199843 A1 9/2005 Jost et al.
2005/0205818 A1 9/2005 Bayley et al.
2005/0223485 A1 * 10/2005 Nijhof ..... E03F 5/0408 4/613
2005/0253102 A1 11/2005 Boilen
2006/0098961 A1 5/2006 Seutter et al.
2006/0101575 A1 5/2006 Louis
2006/0102642 A1 5/2006 Muntzing et al.
2006/0150316 A1 7/2006 Fukuizumi et al.
2006/0151513 A1 7/2006 Shadrach, III
2006/0185074 A1 8/2006 Loberger et al.
2006/0200903 A1 9/2006 Rodenbeck et al.
2006/0207019 A1 9/2006 Vincent
2006/0225200 A1 10/2006 Wierenga
2007/0023565 A1 2/2007 Babikian
2007/0079524 A1 4/2007 Sato et al.
2007/0094787 A1 5/2007 Hwang
2007/0144034 A1 6/2007 Kameishi
2007/0151338 A1 7/2007 Benner et al.
2007/0152082 A1 7/2007 Hyslop
2007/0194637 A1 8/2007 Childe et al.
2007/0204925 A1 9/2007 Bolderheij et al.
2007/0230839 A1 10/2007 Childe et al.
2007/0252551 A1 11/2007 Clothier et al.
2007/0261162 A1 11/2007 Atkinson
2007/0263994 A1 11/2007 Diez et al.

(56) References Cited

U.S. PATENT DOCUMENTS

2007/0278983 A1 12/2007 Clothier et al.
2008/0005833 A1 1/2008 Bayley et al.
2008/0018995 A1 1/2008 Baun
2008/0072668 A1 3/2008 Miyagawa
2008/0078019 A1 4/2008 Allen, Jr. et al.
2008/0083786 A1 4/2008 Marin
2008/0098950 A1 5/2008 Gudjohnsen et al.
2008/0099088 A1 5/2008 Boey
2008/0109956 A1 5/2008 Bayley et al.
2008/0127410 A1 6/2008 Schmitt et al.
2008/0185396 A1 8/2008 Yang et al.
2008/0185398 A1 8/2008 Yang et al.
2008/0185399 A1 8/2008 Yang et al.
2008/0189850 A1 8/2008 Seggio et al.
2008/0193111 A1 8/2008 Seutter et al.
2008/0209760 A1 9/2008 French et al.
2008/0213644 A1 9/2008 Shindoh et al.
2008/0216343 A1 9/2008 Churchill et al.
2008/0216344 A1 9/2008 Churchill et al.
2008/0222910 A1 9/2008 Churchill et al.
2008/0253754 A1 10/2008 Rubin
2008/0256825 A1 10/2008 Hsu
2008/0271527 A1 11/2008 Hewitt
2008/0285134 A1 11/2008 Closset et al.
2008/0289098 A1 11/2008 Kunkel
2008/0301970 A1 12/2008 Hackwell et al.
2008/0313918 A1 12/2008 Dyson et al.
2008/0313919 A1 12/2008 Churchill et al.
2008/0317448 A1 12/2008 Brown et al.
2009/0000023 A1 1/2009 Wegelin et al.
2009/0000024 A1 1/2009 Louis et al.
2009/0000142 A1 1/2009 Churchill et al.
2009/0000147 A1 1/2009 Collins
2009/0031493 A1 2/2009 Tsujita et al.
2009/0034946 A1 2/2009 Simmonds
2009/0049599 A1 2/2009 Parsons et al.
2009/0056011 A1 3/2009 Wolf et al.
2009/0058666 A1 3/2009 Clabaugh
2009/0069870 A1 3/2009 Haase et al.
2009/0077736 A1 3/2009 Loberger et al.
2009/0094740 A1 4/2009 Ji
2009/0100593 A1 4/2009 Lincoln et al.
2009/0113746 A1 5/2009 Churchill et al.
2009/0113748 A1 5/2009 Dyson et al.
2009/0119832 A1 5/2009 Conroy
2009/0119942 A1 5/2009 Aisenberg et al.
2009/0126103 A1 5/2009 Dietrich et al.
2009/0159612 A1 6/2009 Beavis et al.
2009/0236358 A1 9/2009 Rippl et al.
2009/0243243 A1 10/2009 Watson
2009/0249541 A1* 10/2009 Aykens ..... E03C 1/182 4/629
2009/0266157 A1 10/2009 Maruo et al.
2009/0293190 A1 12/2009 Ringelstetter et al.
2009/0293192 A1 12/2009 Pons
2010/0014844 A1 1/2010 Dannenberg et al.
2010/0102410 A1 4/2010 Shimizu et al.
2010/0132112 A1 6/2010 Bayley et al.
2010/0139394 A1 6/2010 Pauer et al.
2010/0154239 A1 6/2010 Hutchinson
2010/0162481 A1* 7/2010 Erlebach ..... E03F 5/04 4/613
2010/0168926 A1 7/2010 Bayley et al.
2010/0192399 A1 8/2010 Sawabe et al.
2010/0199759 A1 8/2010 Prasad
2010/0213208 A1 8/2010 Ben et al.
2010/0219013 A1 9/2010 Liddell
2010/0223993 A1 9/2010 Shimizu et al.
2010/0231392 A1 9/2010 Sherron
2010/0236092 A1 9/2010 Causier
2010/0269364 A1 10/2010 Liu
2010/0276529 A1 11/2010 Nguyen
2010/0287695 A1 11/2010 Houghton et al.
2010/0296799 A1 11/2010 Liu
2011/0006083 A1 1/2011 Walters et al.
2011/0023319 A1 2/2011 Fukaya et al.
2011/0088161 A1* 4/2011 Stimpson ..... A47K 3/40 4/613
2011/0171083 A1 7/2011 Swistak
2011/0277342 A1 11/2011 Ishii et al.
2011/0308009 A1* 12/2011 Davoudi ..... E03C 1/18 4/619
2012/0011739 A1 1/2012 Nakamura
2012/0017459 A1 1/2012 Kikuchi et al.
2012/0017460 A1 1/2012 Kikuchi et al.
2012/0291195 A1 11/2012 Courtney et al.
2012/0291303 A1 11/2012 Courtney et al.
2013/0042494 A1 2/2013 Hsu
2015/0216372 A1 8/2015 Ahmed
2015/0351593 A1 12/2015 Schless
2015/0376881 A1* 12/2015 Moe ..... A47K 10/48 4/638
2017/0105590 A1 4/2017 Muderlak et al.
2017/0198460 A1 7/2017 Kamata et al.
2017/0275860 A1 9/2017 Beck
2018/0016773 A1 1/2018 Chandler et al.
2019/0101219 A1 4/2019 Hatakeyama et al.
2019/0171244 A1 6/2019 Wegelin
2019/0211535 A1 7/2019 Gallob
2019/0242397 A1 8/2019 Adachi et al.
2019/0310390 A1 10/2019 Wegelin et al.
2019/0379751 A1 12/2019 Gagnon et al.
2020/0232199 A1* 7/2020 Brockmeyer ..... E03C 1/182

FOREIGN PATENT DOCUMENTS

AU 2006274708 2/2007
AU 2006274715 2/2007
BE 347407 12/1927
CN 102665512 9/2012
CN 103425370 12/2013
CN 103607935 2/2014
CN 104622348 A 5/2015
CN 205866678 1/2017
CN 108916464 A 11/2018
DE 504089 7/1930
DE 2018695 10/1971
DE 2304815 8/1974
DE 2657164 12/1976
DE 3036623 2/1982
DE 9304270 9/1993
DE 9304160 7/1994
DE 4218658 12/1994
DE 19608157 7/1997
DE 10210474 9/2002
DE 69821140 11/2004
DE 20-2004-012352 12/2004
DE 20-2005-018472 2/2006
DE 10-2009-003070 11/2010
EP 0274785 7/1988
EP 1057942 12/2000
EP 1241301 9/2002
EP 1250878 10/2002
EP 1258568 11/2002
EP 1057441 9/2006
EP 1912549 3/2010
EP 2177142 4/2010
EP 2177142 A2 4/2010
EP 2277424 1/2011
EP 2744380 7/2015
GB 549766 12/1942
GB 737054 9/1955
GB 909069 10/1962
GB 2249026 4/1992
GB 2450563 12/2008
GB 2505863 3/2014
JP 49-037685 4/1974
JP 1256632 10/1989
JP 04-136195 12/1992
JP 5163748 6/1993
JP 05-055988 7/1993
JP 06-062977 3/1994
JP 11113794 4/1994
JP 8-140891 6/1996

(56) References Cited

FOREIGN PATENT DOCUMENTS

| | | | |
|---|---|---|---|
| JP | 08-164088 | | 6/1996 |
| JP | 08-196470 | | 8/1996 |
| JP | 08-266939 | | 10/1996 |
| JP | 9-056640 | | 3/1997 |
| JP | 9-135788 | | 5/1997 |
| JP | 9242155 | | 9/1997 |
| JP | 10-113304 | | 5/1998 |
| JP | 10-113305 | | 5/1998 |
| JP | 10-248748 | | 9/1998 |
| JP | 10-257992 | | 9/1998 |
| JP | 11-000283 | | 1/1999 |
| JP | 11-113789 | | 4/1999 |
| JP | 2000-000178 | | 1/2000 |
| JP | 2000-000180 | | 1/2000 |
| JP | 2000-157448 | | 6/2000 |
| JP | 2000-184987 | | 7/2000 |
| JP | 2000-271039 | | 10/2000 |
| JP | 2000-282528 | | 10/2000 |
| JP | 2000-300461 | | 10/2000 |
| JP | 2001020338 | A | 1/2001 |
| JP | 2001-104213 | | 4/2001 |
| JP | 2001-140305 | | 5/2001 |
| JP | 2002197559 | A | 7/2002 |
| JP | 2002-345682 | | 12/2002 |
| JP | 2003-153823 | | 5/2003 |
| JP | 2004-261510 | | 9/2004 |
| JP | 2004321485 | | 11/2004 |
| JP | 2006018480 | | 1/2006 |
| JP | 2006-081925 | | 3/2006 |
| JP | 2006-101987 | | 4/2006 |
| JP | 2006-192250 | | 7/2006 |
| JP | 2006-204738 | | 8/2006 |
| JP | 2006-304926 | | 11/2006 |
| JP | 2007-054670 | | 3/2007 |
| JP | 2007-082904 | | 4/2007 |
| JP | 2007-098106 | | 4/2007 |
| JP | 2008-005883 | | 1/2008 |
| JP | 2008-099797 | | 5/2008 |
| JP | 2008-110240 | | 5/2008 |
| JP | 4207911 | | 1/2009 |
| JP | 2009127379 | | 6/2009 |
| JP | 2010-046238 | | 3/2010 |
| JP | 2010-075602 | | 4/2010 |
| JP | 2010-110450 | | 5/2010 |
| JP | 2011-055859 | | 3/2011 |
| JP | 2012145545 | | 8/2012 |
| JP | 2014015781 | | 1/2014 |
| JP | 2014118798 | | 6/2014 |
| KR | 100711544 | | 4/2007 |
| KR | 20070082683 | | 8/2007 |
| KR | 20090112064 | A | 10/2009 |
| NL | 1017777 | | 10/2002 |
| WO | 96/26795 | | 9/1995 |
| WO | 01/16436 | | 3/2001 |
| WO | 2006/055681 | | 5/2006 |
| WO | 2007/011747 | | 1/2007 |
| WO | 2007/015036 | | 2/2007 |
| WO | 2007/015039 | | 2/2007 |
| WO | 2007/015046 | | 2/2007 |
| WO | 2009/039290 | | 3/2009 |
| WO | 2009/062546 | | 5/2009 |
| WO | 2010/088975 | | 8/2010 |
| WO | 2010/089927 | | 8/2010 |
| WO | 2010/095250 | | 8/2010 |
| WO | 2010/095251 | | 8/2010 |
| WO | 2010/119536 | | 10/2010 |
| WO | 2011/009156 | | 1/2011 |
| WO | 2011/044247 | | 4/2011 |
| WO | 2011/074018 | | 6/2011 |
| WO | 2011/077625 | | 6/2011 |
| WO | 2012175860 | | 12/2012 |
| WO | 2013114056 | | 8/2013 |

OTHER PUBLICATIONS

Chinese Office Action, CN 201780044697.4, dated Mar. 27, 2020.
International Search Report and Written Opinion, PCT/US2020/012904, dated Mar. 21, 2020.

* cited by examiner

LAVATORY DRAIN SYSTEM

CROSS-REFERENCE TO RELATED APPLICATIONS

This application is a continuation-in-part application of and claims priority to now pending U.S. patent application Ser. No. 16/057,220, filed on Aug. 7, 2018, which is a continuation-in-part application of and claims and claims priority issued U.S. Pat. No. 10,041,236, filed on Jun. 8, 2016 and issued on Aug. 7, 2018, the entire contents of both are hereby expressly incorporated by reference into this application.

BACKGROUND OF THE INVENTION

1. Field of the Invention

The present invention relates in general to the field of lavatory systems. More particularly, the present invention relates to a lavatory system having a multi-function fixture. Specifically, a preferred embodiment of the present invention relates to a multi-function fixture for a lavatory system at which a user receives soap and water to wash hands and at which an air flow is provided to dry the hands after washing.

2. Discussion of the Related Art

As is known to those skilled in the art, washrooms have historically included separate soap dispensers, wash basins with faucets, and hand dryers or towel dispensers. Soap dispensers may be located between wash stations or in a location convenient to several wash stations. When a user dispenses soap, excess soap may drip from the dispenser. If a user has previously placed hands under the faucet to first wet hands, then water also drips from the user's hands as soap is applied. If the soap dispenser is not located over the wash basin, the excess soap and/or water drips on the deck of the basin or on the floor depending on the location of the soap dispenser. Further, as a user moves between the wash basin and the hand dryer or towel dispenser, excess water drips from the user's hands to the deck of the basin or to the floor depending on the location of the hand dryer or towel dispenser. The need to move between stations when washing hands results in an undesirable mess in the washroom.

To reduce the amount of mess, it has been known to add a soap dispenser next to the faucet where both are located over the same basin. However, this still requires a user moving to a hand dryer or towel dispenser. Recently, lavatory systems have been developed that further include a drying station also located over the wash basin. Thus, the entire process of washing and drying a user's hands may be completed without moving away from the wash basin.

However, such stations have so far required more space per user than existing lavatory systems. The addition of a drying station may require a larger basin. Further, the soap dispenser, faucet, and hand dryer create three fixtures that must be positioned on the deck of the lavatory system and arranged around the basin. Thus, it would be desirable to provide a fixture for a lavatory system that incorporates each of the dispensing features and that may be realized without requiring additional space per user.

SUMMARY AND OBJECTS OF THE INVENTION

The present invention is directed to a fixture for a lavatory system that incorporates each of the dispensing features required to wash a user's hands and that does not require additional space per user. Thus, it is a primary object of the invention to provide a multi-function fixture that dispenses soap and water to a user. It is another object of the invention to provide visual indicators to a user to direct the user to each dispensing region on the multi-function fixture to receive soap and water, as desired. It is still another object of the invention to provide a multi-function fixture that may be installed within the space of existing wash stations. Yet another object of the invention is to provide an apparatus that has one or more of the characteristics discussed above but which is relatively simple to manufacture and assemble and maintain using a minimum of equipment.

The lavatory fixture includes a first leg and a second leg, where a first end of each leg is configured to be mounted to an upper surface of a deck for the lavatory fixture. The leg extends upward from the deck and forward toward the basin, such that a second end of each leg is located over the basin of the lavatory fixture. A connecting section extends between the second ends of each leg and is positioned over the basin of the lavatory fixture. The connecting section includes outlets to dispense soap and water to wash a user's hands. The fixture also includes indicators located proximate to each of the outlets to provide an indication to the user as to the location of each outlet and/or to guide a user to the outlets during the hand washing process. At least one sensor located near each outlet identifies the presence of a user's hands near the outlet and dispenses soap or water, accordingly. A controller within the lavatory fixture receives inputs from each sensor and activates the appropriate pump, valve, and the like to deliver the desired product at the appropriate outlet.

In accordance with a first embodiment of the invention, these objects are achieved by providing a lavatory system comprising a basin and a fixture. The fixture extends over the basin for dispensing soap and water. The fixture includes a first leg, a second leg spaced apart from the first leg, and a connecting section for connecting the first leg to the second leg. There is a first passage in the first leg and a second passage in the second leg. A first tube carries the water through either the first passage or the second passage, and a second tube carries soap through either the first passage or the second passage. The connecting section includes first output for dispensing the water and second output for dispensing the soap.

According to another aspect of the invention, the fixture is a single casting, the first leg includes a first base, the second leg includes a second base, and each of the first and second bases are configured to attach to the basin. The lavatory system may include a deck surrounding at least a portion of the basin and having a first hole for receiving a portion of the first base and a second hole for receiving a portion of the second base.

According to yet other aspects of the invention, an aerator may be mounted proximate the first outlet. The aerator is configured with an entrance for the first tube, which adds a swirling motion to the water. The connecting section includes an upper surface and a lower surface, and the aerator is nearly flush with the lower surface of the connecting section.

According to still further aspects of the invention, the lavatory system may include at least one sensor within the connecting section and proximate the first outlet and at least one sensor within the connecting section and proximate the second outlet. Further, a lower surface of the connecting section may include a translucent material so that sensors can sense through the material. The lavatory system may also include a first indicator identifying the first outlet and a second indicator identifying the second outlet. A control circuit enables each of the first indicator and the second indicator to indicate to a user where to put their hands.

According to another embodiment of the invention, a fixture for a lavatory system having a deck and a basin in the deck is disclosed. The fixture includes a first leg, a second leg, and a connecting section. The first leg has a first end, a second end, and a first passage extending between the first end and the second end of the first leg. Similarly, the second leg has a first end, a second end, and a second passage extending between the first end and the second end of the second leg. The connecting section extends between the first leg and the second leg and includes soap and water outlets. The fixture includes a first tube operable to carry the water through either the first leg or the second leg to the water outlet on the connecting section and a second tube operable to carry the soap through either the first leg or the second leg to the soap outlet on the connecting section.

According to another aspect of the invention, the connecting section has a first end and a second end. The first end is in contact with the second end of the first leg, and the second end is in contact with the second end of the second leg. The first end of the first leg includes a first mounting surface configured to be mounted to the deck. The first mounting surface also may include an opening extending therethrough and in communication with the first passage. Similarly, the first end of the second leg includes a second mounting surface configured to be mounted to the deck. The second mounting surface may also include an opening extending therethrough and in communication with the second passage.

According to yet another aspect of the invention, at least one sensor may be proximate the water outlet and at least one sensor may be proximate the soap outlet. The at least one sensor proximate the water outlet is configured to signal a control circuit to dispense water from the water outlet, while the at least one sensor proximate the soap outlet is configured to signal the control circuit to dispense soap from the soap outlet. Further, the first tube extends through the first passage and the second tube extends through the second passage.

According to still another embodiment of the invention, a lavatory fixture for a wash station includes a first and second generally r-shaped legs. The first generally r-shaped leg includes a first end, a second end, and a first passage extending through the first leg. The second generally r-shaped leg is displaced from the first leg and includes a first end, a second end, and a second passage extending through the second leg. The fixture also includes a connecting section having a first end, a second end, and a plurality of outlets. The first end of the connecting section is connected to the second end of the first leg, and the second end of the connecting section is connected to the second end of the second leg.

According to another aspect of the invention, a first outlet of the plurality of outlets, is located proximate the first end of the connecting section, and a second outlet of the plurality of outlets is located proximate the second end of the connecting section. A first tube is fluidically coupled to a soap pump and may extend through the first passage and to the first outlet, while a second tube is fluidically coupled to a water valve and may extend through the second passage and to the second outlet.

According to yet another aspect of the invention, a first indicator may be proximate the first outlet and a second indicator may be proximate a second outlet. Similarly, at least one sensor may be proximate the first outlet and at least one sensor may be proximate the second outlet.

According to another embodiment of the invention, a lavatory system may include a basin having a first side, opposite a second side, the first and second sides both extending downward to a fourth side, and a third side extending downward and between the first and second side. The fourth side is sloped inward and downward toward the third side. The basin may further include a U-shaped drain channel formed in the fourth side. The drain channel includes a rear wall, a front wall extending downward from the lower surface of the basin, and a lower surface. The drain channel also extends longitudinally across a width of the basin. The lavatory system also includes a drain cap removably mounted within the drain channel and extending longitudinally across a width of the basin. The drain cap includes a front surface, a rear surface, and a top surface. In addition, a longitudinal width of the drain cap extending across a width of the basin is substantially the same length as the drain channel.

According to another aspect of the invention, the top surface of the drain cap is coplanar with the fourth side of the basin. Further, the top surface of the drain cap angles upward from the fourth side of the basin.

According to yet another aspect of the invention, an opening may be formed in the lower surface of the drain channel including a plurality of notches formed therein. The drain cap may include a plurality of tabs configured to interfit with the plurality of notches of the drain channel. In addition, a plurality of bumpers may be affixed to at least one of the front and rear surfaces of the drain cap. In such an embodiment of the invention, a first space between the front surface of the drain cap and the front wall of the drain channel is configured to allow the plurality of bumpers affixed to the front surface of the drain cap to fit in the first space when the drain cap is mounted with the drain channel, while a second space between the rear surface of the drain cap and the rear wall of the drain channel is configured to allow the plurality of bumpers affixed to the rear surface of the drain cap to fit in the second space when the drain cap is mounted with the drain channel.

According to another aspect of the invention, a drain plate may be inserted into the drain channel between the lower surface of the drain channel and the drain cap. As a result, an upper chamber is defined between the drain cap and the drain plate and a lower chamber is defined between drain plate and the lower surface of the drain channel. Further, a plurality of openings may be disposed along the drain plate to allow fluid to flow from the first chamber to the second chamber.

According to yet another aspect of the invention, an upper chamber may be defined by the drain channel and the drain cap and a lower chamber may be disposed below the lower surface of the drain channel. In such an embodiment of the invention, a pipe is disposed below the lower surface of the drain channel to form the lower chamber. A plurality of openings may be formed in the lower surface of the drain channel to fluidically couple the upper and lower chambers.

According to another aspect of the invention, the top surface of the drain cap may be configured to guide the direction of airflow from a fixture of the lavatory system. In such an embodiment of the invention, the basin may include a ridge protruding from at least one of the first side, a second side, and a third side of the basin. The ridge protrudes over the basin and is configured to collect a portion of airflow from the fixture of the lavatory system. In addition, a channel may be formed on a rear side of the basin. The channel directs airflow from the basin to a return duct of a fan.

According to yet another aspect of the invention, an opening may be formed in at least one of the first side, a second side, and a third side of the basin. In such an instance, a channel may be formed on a rear side of the basin. The channel directs airflow from the basin to a return duct of a fan. Additionally, the opening may include a series of louvres to prevent water from entering the opening.

According to another embodiment of the invention, a lavatory system includes a basin and a fixture extending over the basin. The basin includes a first side opposite a second side, the first and second sides both extending downward to a fourth side, and a third side extending downward, between the first and second side. The fourth side is sloped inward and downward toward the third side. The basin also includes a U-shaped drain channel formed in the fourth side. The drain channel includes a rear wall, a front wall extending downward from the lower surface of the basin, and a lower surface. Further, the drain channel extends longitudinally across a width of the basin. The basin further includes a drain opening formed in the lower surface of the drain channel. The lavatory system also includes a drain cap removably mounted within the drain channel and extending longitudinally across a width of the basin. The drain cap includes a front surface, a rear surface, and a top surface. A first chamber is formed within the drain channel and below the drain cap, while a second chamber is disposed below the first chamber.

According to another aspect of the invention, a drain plate may be inserted into the drain channel between the lower surface of the drain channel and the drain cap. The drain plate includes at least one opening spaced longitudinally along the drain plate to fluidically couple the first and second chamber. The second chamber is disposed below the drain plate.

According to yet another aspect of the invention, a pipe may be located below the drain channel to form the lower chamber. Further, at least one opening may be formed through the lower surface of the drain channel and into the pipe to establish fluid communication between the upper chamber and the lower chamber.

According to another embodiment of the invention, a lavatory system includes a basin and a fixture extending over the basin. The basin includes a first side opposite a second side, the first and second sides both extending downward to a fourth side, and a third side extending downward and between the first and second side. The fourth side is sloped inward and downward toward the third side. The basin also includes a U-shaped drain channel formed in the fourth side. The drain channel includes a rear wall, a front wall extending downward from the lower surface of the basin, and a lower surface. In addition, the drain channel extends longitudinally across a width of the basin. The basin further includes a drain opening formed in the lower surface of the drain channel. Additionally, the lavatory system includes a drain cap removably mounted within the drain channel. The drain cap includes a front surface, a rear surface, a top surface. Further, the drain cap extends longitudinally across a width of the basin and is configured to guide the direction of airflow from the fixture. In addition, a channel is formed behind at least one of the first side, second side, or third side of the basin to collect airflow. An opening is also formed through an upper portion of the basin to allow air flow from the basin to the channel.

According to another aspect of the invention, a ridge may protrude from at least the first side, the second side, or the third side of the basin to collect a portion of the airflow into the channel. In addition, a series of louvers may be located in the opening configured to prevent water from entering the opening.

According to yet another aspect of the invention, the lavatory system may include a return duct coupled to the channel in order to provide air to an input of a fan. Further, a filter may be included between the return duct and the input of the fan.

These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
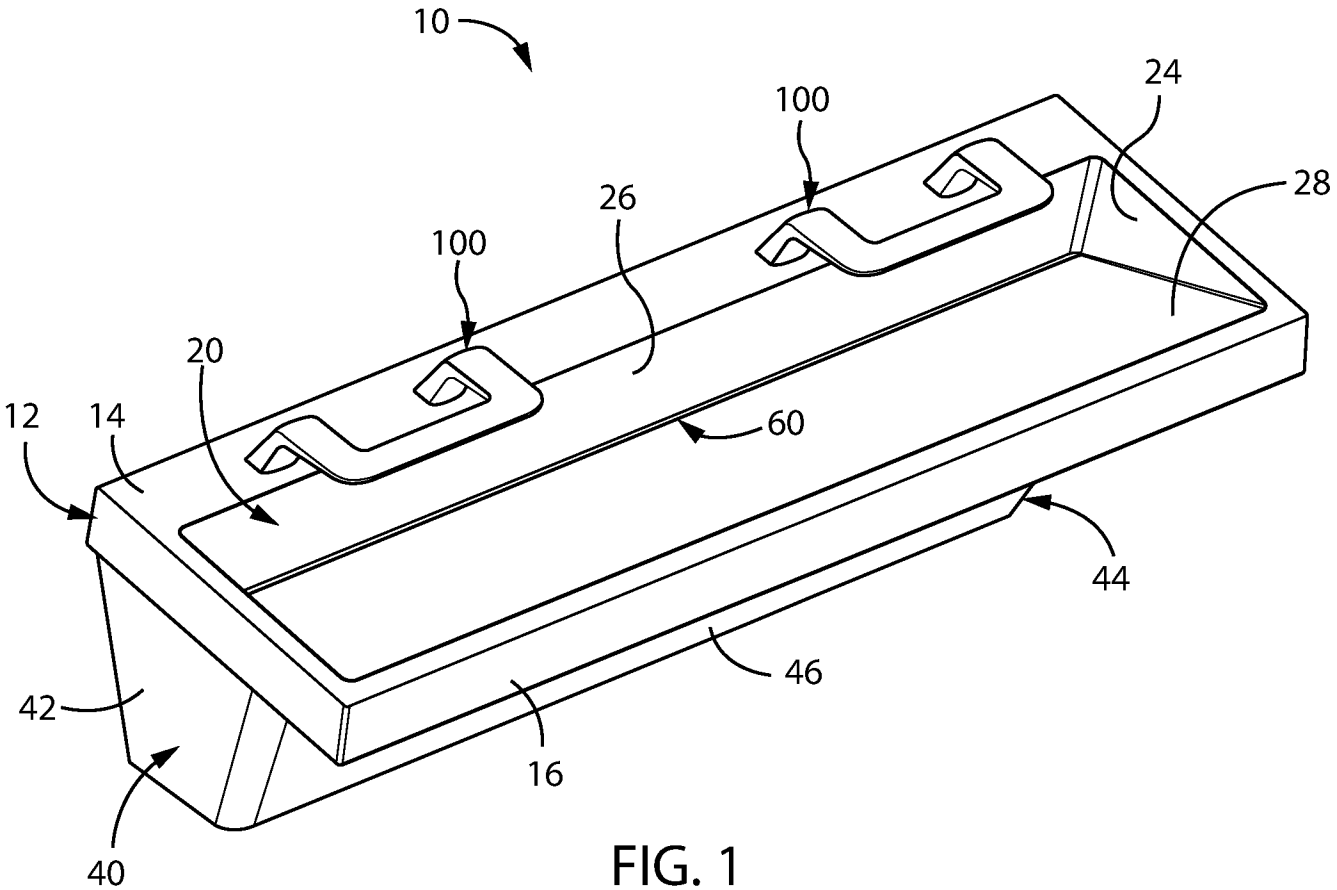
FIG. 1 is an isometric view of a lavatory system incorporating a multi-function fixture according to one embodiment of the present invention.
Figure 2:
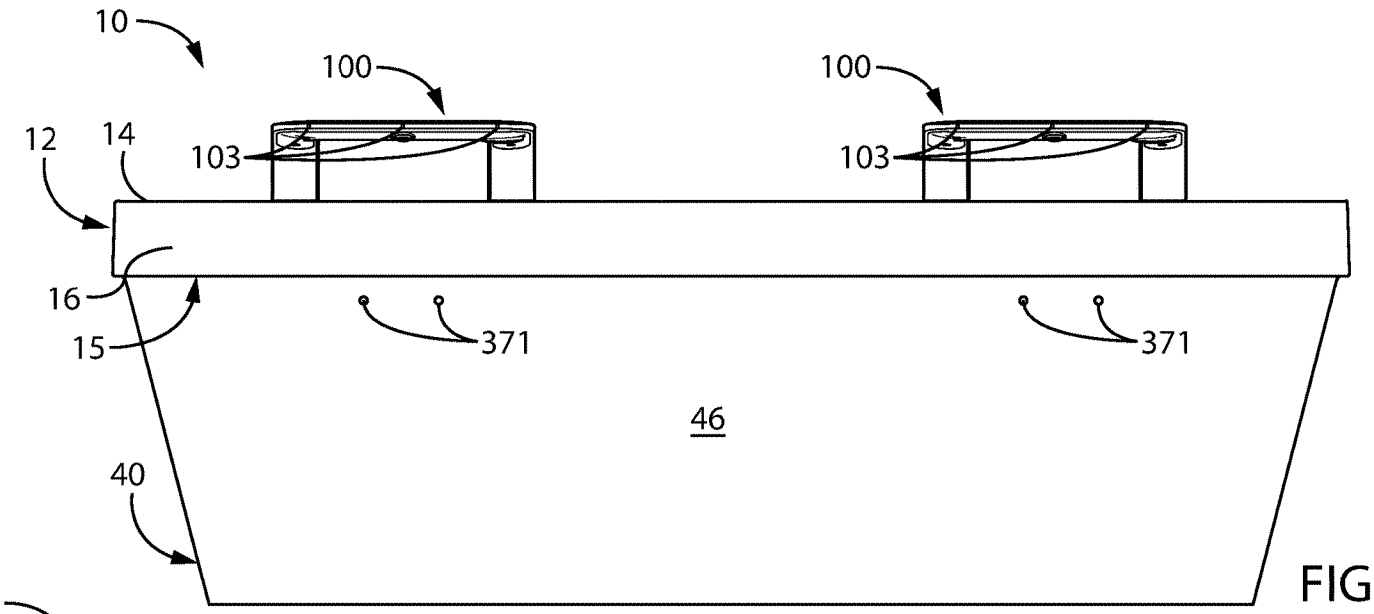
FIG. 2 is front elevation view of the lavatory system of FIG. 1.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected, attached, or terms similar thereto are often used. They are not limited to direct connection but include connection through other elements where such connection is recognized as being equivalent by those skilled in the art.

DESCRIPTION OF PREFERRED EMBODIMENTS

The present invention and the various features and advantageous details thereof are explained more fully with reference to the non-limiting embodiments described in detail in the following description.

Throughout this description, various terms denoting direction, such as left and right, front and rear, up and down, top and bottom, and the like may be used. The directions are not intended to be limiting but are used to describe relationships of elements with respect to each other in the accompanying drawings. Unless mutually exclusive, it is contemplated that the elements may be reversed, for example, by turning a component around or upside down without deviating from the scope of the present invention.

Figure 5:
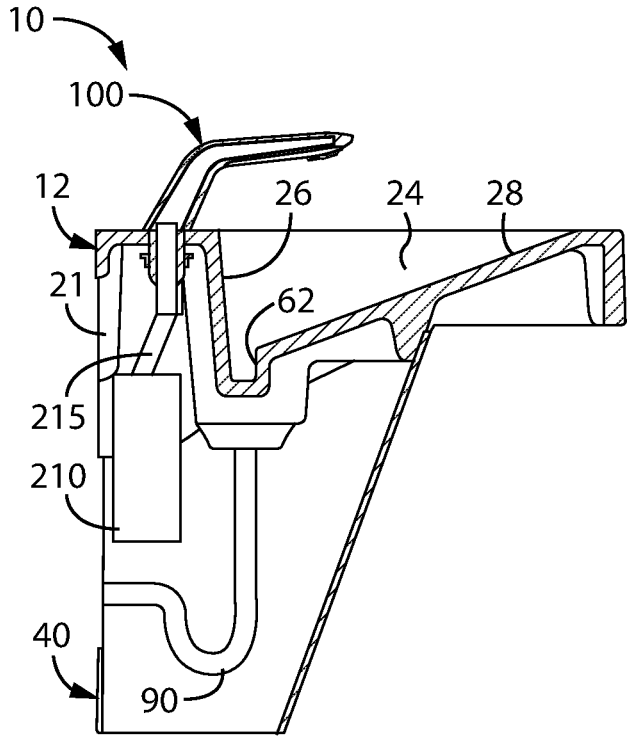
FIG. 5 is a sectional view of the lavatory system of FIG. 3 taken at 5-5.
Figure 6:
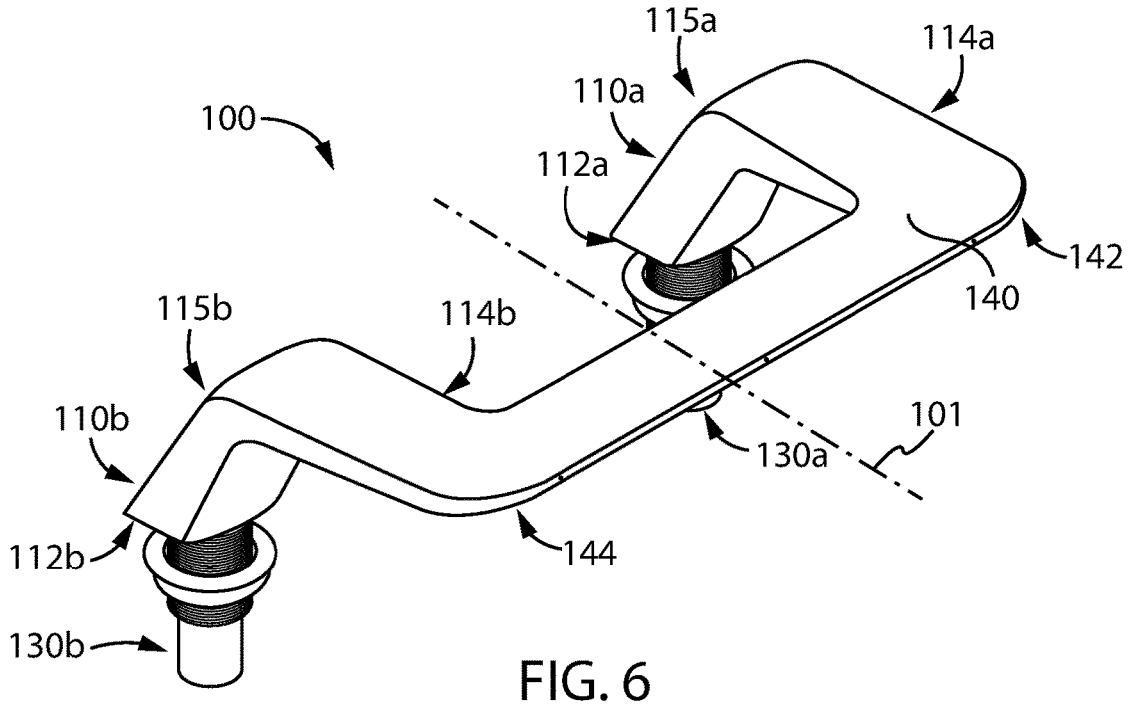
FIG. 6 is an isometric view of a multi-function fixture according to one embodiment of the invention.
Figure 7:
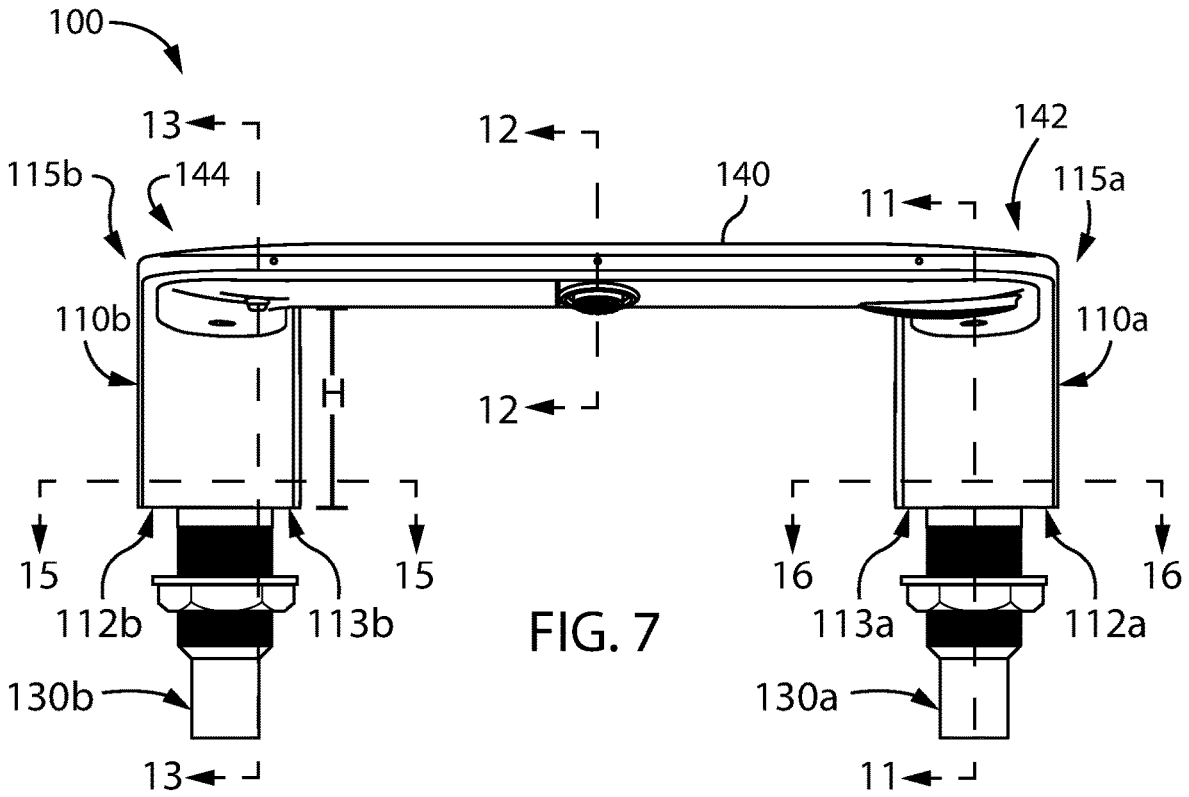
FIG. 7 is a front elevation view of the multi-function fixture of FIG. 6.
Figure 8:
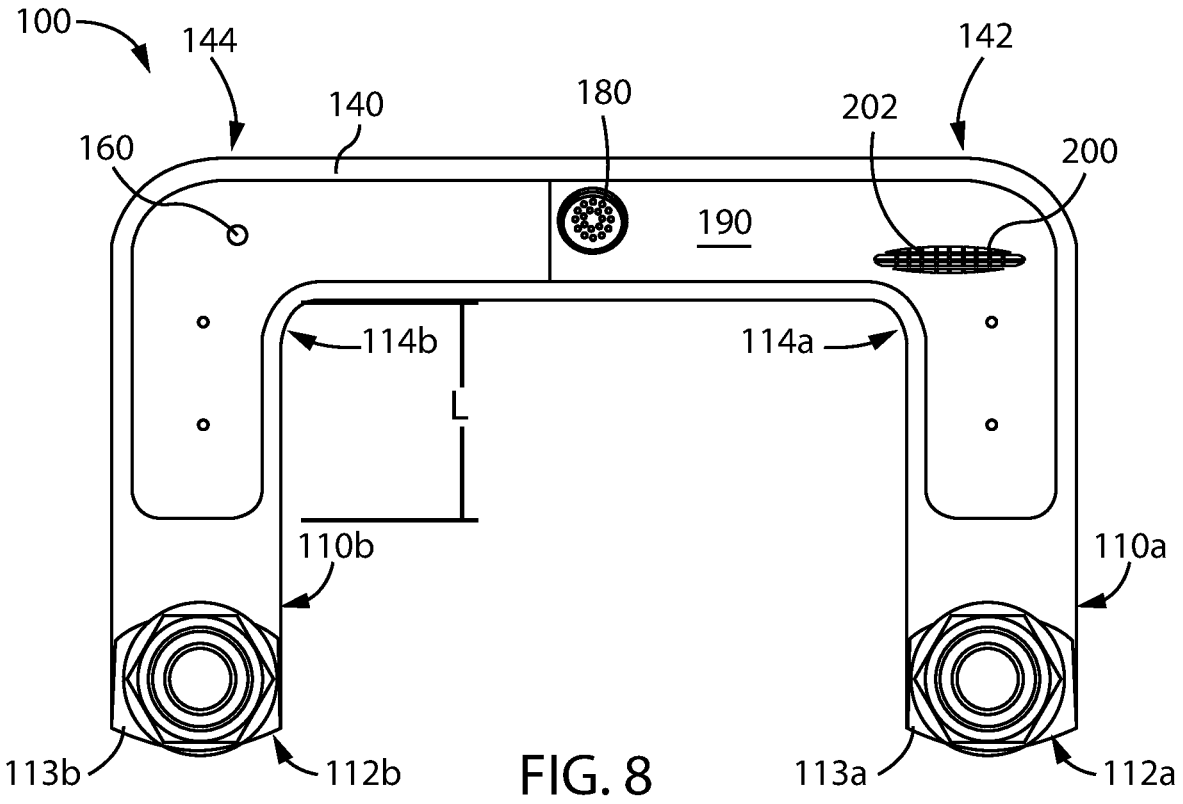
FIG. 8 is a bottom plan view of the multi-function fixture of FIG. 6.
Figure 9:
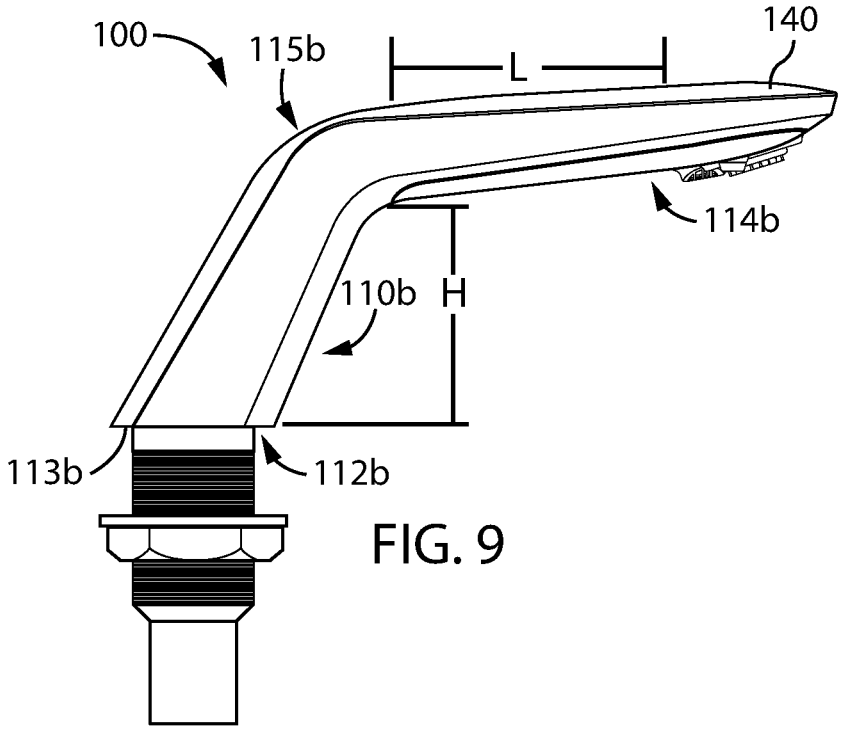
FIG. 9 is a right side elevation view of the multi-function fixture of FIG. 6.

Turning initially to FIG. 1, a lavatory system 10 in accordance with one embodiment of the invention is illustrated. The lavatory system 10 includes a deck 12 that is configured to be mounted to a wall. With reference also to FIG. 5, wall mounts 21 are secured to the wall and the deck 12 is secured to the wall mounts 21. The deck 12 has an upper surface 14 and an outer periphery 16 extending downward from the upper surface 14 and around the deck 12. A basin 20 is located within the deck 12. According to one embodiment of the invention, the deck 12 and the basin 20 may be integrally formed as a single unit. According to another embodiment of the invention, the basin 20 may be mounted to the deck 12. It is further contemplated that the lavatory system 10 may be free-standing, supported by the floor rather than being wall mounted. Rather, than including a wall mount 21, a support frame (not shown) may extend up from the floor, or other surface, on which the lavatory system 10 is installed.

Figure 3:
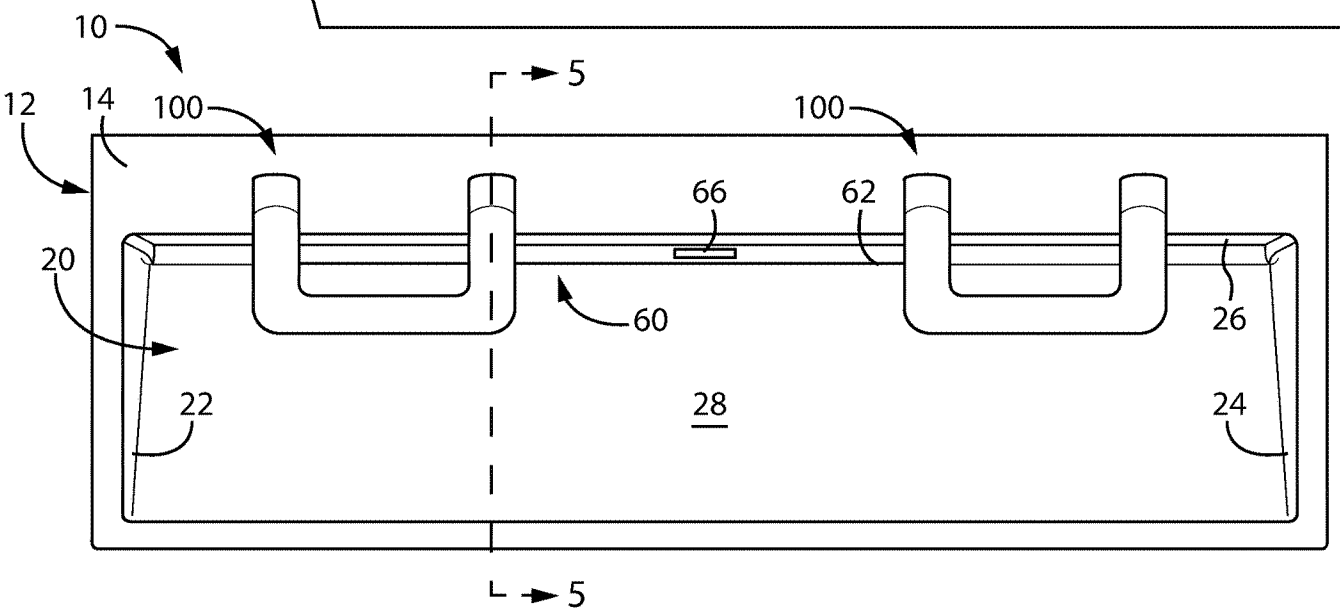
FIG. 3 is a top plan view of the lavatory system of FIG. 1.
Figure 4:
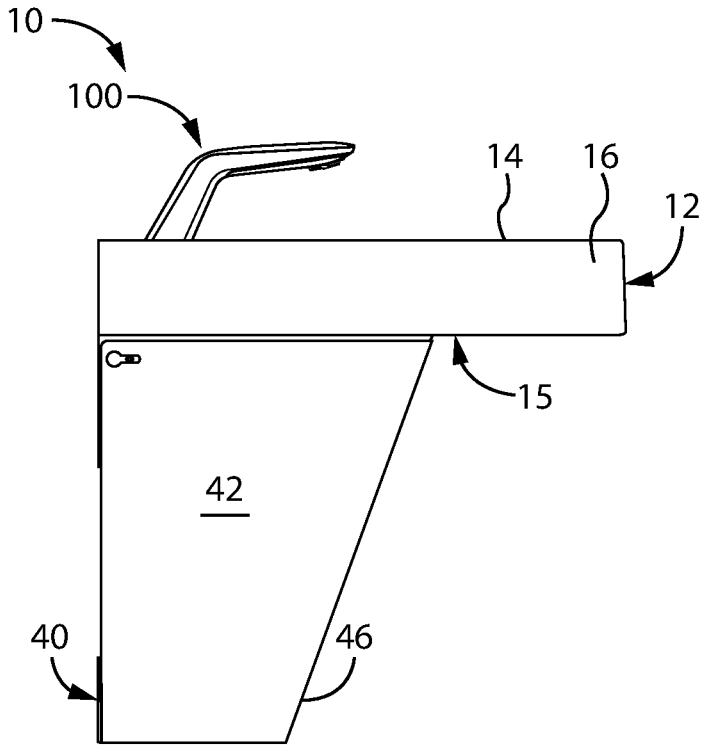
FIG. 4 is a side elevation view of the lavatory system of FIG. 1.

The basin 20 is a recessed area below the upper surface 14 of the deck 12 and is configured to receive products dispensed into the lavatory system. According to the illustrated embodiment, the basin 20 includes a first side 22 (see also FIG. 3) and a second side 24, where the second side 24 is opposite the first side. Each of the first and second sides 22, 24 extend generally orthogonal to and away from the wall on which the lavatory system 10 is mounted. The basin 20 also includes a third side 26 extending downward from an upper edge which joins the upper surface 14 of the deck 12 along the rear of the basin and further extends between the first side 22 and the second side 24. With reference also to FIG. 5, the third side 26 extends downward and the lower end of the third side forms, in part, a drain channel 62 in the bottom of the basin 20. The basin 20 further includes a fourth side 28 extending downward from an upper edge which joins the upper surface 14 of the deck 12 along the front of the basin and also extends between the first side 22 and the second side 24. The fourth side 28 of the basin 20 is sloped inward and downward from the front edge of the basin to a front edge of the drain channel 62. Although the basin 20 is described in detail with respect to the illustrated embodiment, it is understood that the basin 20 may take various shapes as would be understood to one skilled in the art without deviating from the scope of the invention.

The lavatory system 10 includes a housing 40 located below the deck 12 and extending around the lower portion of the lavatory system 10. According to the illustrated embodiment, the housing 40 includes a first side 42 and a second side 44, where the second side is opposite the first side. A rear edge of each of the first side 42 and the second side 44 abuts the wall to which the lavatory system 10 is mounted. Each of the first side 42 and the second side 44 extend forward, generally orthogonal to the wall. A front surface 46 of the housing extends downward and to the rear from a lower surface 15 of the deck 12. The front surface 46 extends the height of each of the first and second sides 42, 44. According to one embodiment of the invention, each of the first side 42, second side 44, and front surface 46 extend to the floor. According to another embodiment of the invention, the each of the first side 42, second side 44, and front surface 46 extend to some height above the floor. The front surface 46 is sloped to the rear from where it abuts the lower surface 15 of the deck 12. It is contemplated that the housing 40 may include a bottom surface (not shown) if the housing does not extend to the floor. Optionally, the housing may be open on the bottom as defined by the periphery of the first side 42, second side 44, front surface 46 and wall to which the lavatory system 10 is mounted. The housing 40 encloses the components of the lavatory system 10 located below the deck to provide a measure of protection to the components and to provide an aesthetically pleasing appearance to the lavatory system 10. Although the housing 40 is described in detail with respect to the illustrated embodiment, it is understood that the housing 40 may take various shapes as would be understood to one skilled in the art without deviating from the scope of the invention.

The lavatory system 10 further includes a drain system 60 extending longitudinally across the width of the basin 20. With reference also to FIGS. 18-21, the drain system 60 includes a drain channel 62 and a drain cap 70. According to the illustrated embodiment, the drain channel 62 is generally u-shaped. The drain channel 62 has a rear wall 63 and a front wall 64 extending the width of the basin 20. The rear wall 63 of the drain channel 62 may be coplanar with the third side 26 of the basin 20 and form a continuous surface. Optionally, the drain channel 62 may be offset from the third side 26 of the basin, forming a channel in a lower surface (not shown) of the basin 20. The drain channel 62 includes a lower surface 65 which also extends the width of the basin between the rear wall 63 and the front wall 64. An opening 66 in the lower surface 65 of the drain channel 62 allows waste water to exist the basin 20 into a drainpipe 90 (as shown in FIG. 5). The periphery of the drain opening 66 includes a pair of notches 68, where a first notch 68 is located to the rear of the drain opening 66 and a second notch is located to the front of the drain opening 66. Each notch 68 is configured to receive a tab 76 from the drain cap 70 as will be discussed in more detail below.

The drain cap 70 is configured to be removably mounted within the drain system 60. The drain cap 70 includes a front surface 72, a rear surface 74, and a top surface 73, where the top surface 73 spans between the front surface 72 and the rear surface 74 and each of the front, rear, and top surfaces extend the width of the drain channel 62. Each of the front surface 72 and the rear surface 74 have a tab 76 extending downward from the respective surface. The tab 76 includes a first surface 77, which is generally coplanar with and protrudes downward from the corresponding front or rear surface, and a second surface 78, which is generally orthogonal to and protrudes outward from the first surface 77. Preferably, the drain cap 70 and the tabs 76 are constructed of a sheet material, such as a stainless steel. The thickness of the sheet material provides sufficient rigidity that the drain cap 70 retains its desired shape if removed from the drain channel 62. However, the width of each tab 76 and the thickness of the sheet material for the drain cap 70 allows the tab 76 to deflect inward when a force is applied. Such a force may be applied, for example, when inserting the drain cap 70 into the drain channel. Each tab 76 is deflected inward as the drain cap 70 is inserted into the drain channel and as each tab 76 is inserted through the notch 68 in the periphery of the drain opening 66. The height of the first surface 77 of the tab 76 is equal to or greater than a thickness of the lower surface 65 of the drain channel 62. As a result, when the drain cap 70 continues to be inserted, the tab 76 extends through the lower surface 65. The material from which the tab 76 is made is resilient such that it returns to its original position once the tabs 76 are fully through the opening 66 in the drain channel 62. The second surface 78 of each tab 76 extends under the lower surface 65 of the drain channel, positively retaining the drain cap 70 within the drain channel 62. Applying pressure to each tab 76 such that the tab is again biased inward a sufficient distance that the second surface 78 is moved from beneath the lower surface 65 and within the periphery of the opening 66 of the drain channel 62 allows the drain cap 70 to be removed from the drain channel 62.

It is further contemplated that each of the front surface 72 and the rear surface 74 of the drain cap 70 include a series of bumpers 75 affixed to the surface and spaced out along the length of the drain cap. A first space 91 and a second space 93 are formed around the drain cap 70, such that the bumpers 75 fit between the front surface 72 of the drain cap 70 and the front wall 64 of the drain channel 62 and between the rear surface 74 of the drain cap 70 and the rear wall 63 of the drain channel 62. The bumpers 75 define a press fit between the surfaces and help align the drain cap 70 within the drain channel 62. In addition, because the drain cap 70 is preferably made from a metal material, such as stainless steel, and the basin 20 and drain channel 62 are preferably made from a synthetic resin material, stone material, or combination thereof, the bumpers 75 aid in preventing damage to the drain channel 62 from the drain cap 70 as the cap is inserted into or removed from the channel.

Further, the top surface 73 of the drain cap 70 may be configured to help guide the direction of airflow dispensed from fixture 100. As will be discussed in more detail below, the fixture 100 is operative to dispense air flow into the basin 20 to dry a user's hands after washing. With further reference to FIGS. 32-37, a direction of airflow is indicated by arrows in the figures. The air is dispensed downward from the fixture 100 where it first hits the fourth side 48 of the basin 20 which is sloped downward and to the rear of the basin 20. The air flow generally follows the slope of the fourth side 48 toward the drain channel 62.

Figure 22:
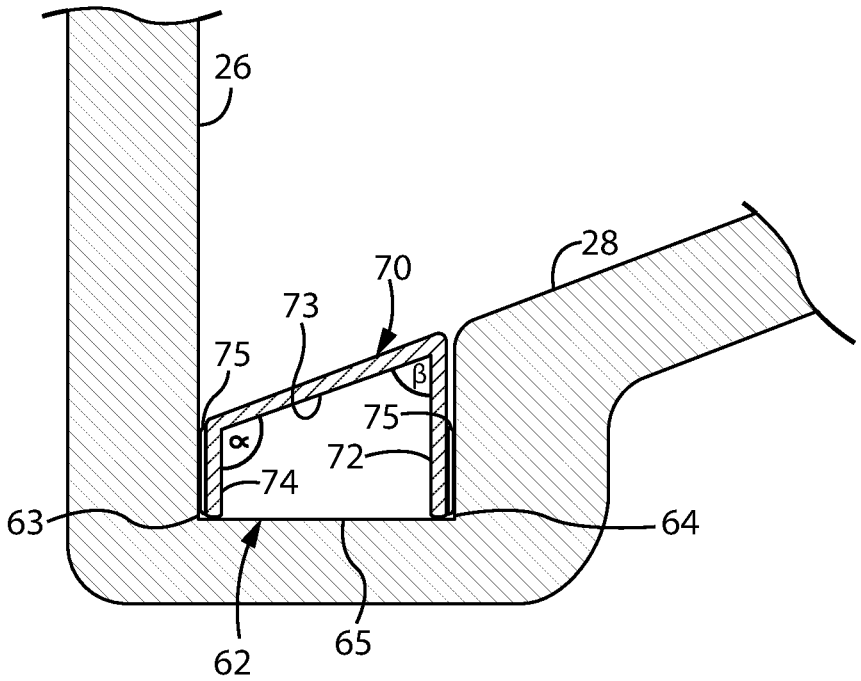
FIG. 22 is a sectional view of a basin, drain channel, and drain cover for the lavatory system according to another embodiment of the drain cover.

According to one embodiment of the invention, the drain cap 70 may be configured to guide the direction of the airflow toward the corners of the basin 20. With reference to FIG. 22, the front surface 72 of the drain cap 70 may be longer than the rear surface 74. As a result, the top surface 73 is sloped downward from the front wall 64 to the rear wall 63 of the drain channel 62. A first angle, a, defined between the rear surface 74 and the top surface 73 of the drain cap 70 is an obtuse angle. A second angle, B, defined between the front surface 72 and the top surface 73 of the drain cap 70 is an acute angle. As shown in FIG. 22, the drain cap 70 may be configured such that the top surface 73 of the drain cap 70 is coplanar with the fourth side 28 of the basin 20. The air continues to flow from the fourth side 28 of the basin along the top surface 73 of the drain cap 70 until it intersects with the third side 26 of the basin 20. The air is then deflected both to the left and the right along the third side 26 of the basin and along the top surface 73 of the drain cap 70 toward the first and second sides 22, 24 of the basin 20.

Figure 23:
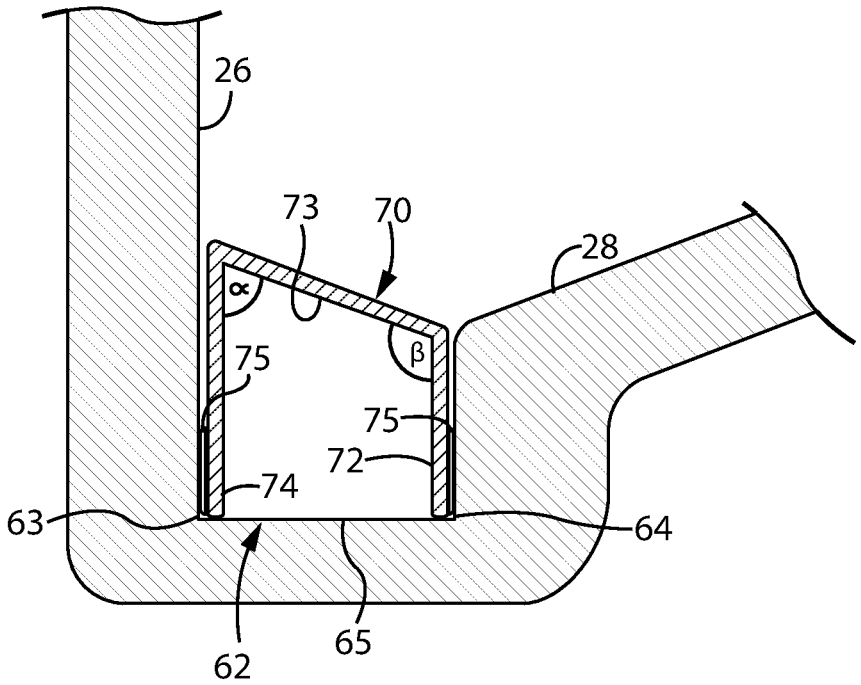
FIG. 23 is a sectional view of a basin, drain channel, and drain cover for the lavatory system according to another embodiment of the drain cover.
Figure 24:
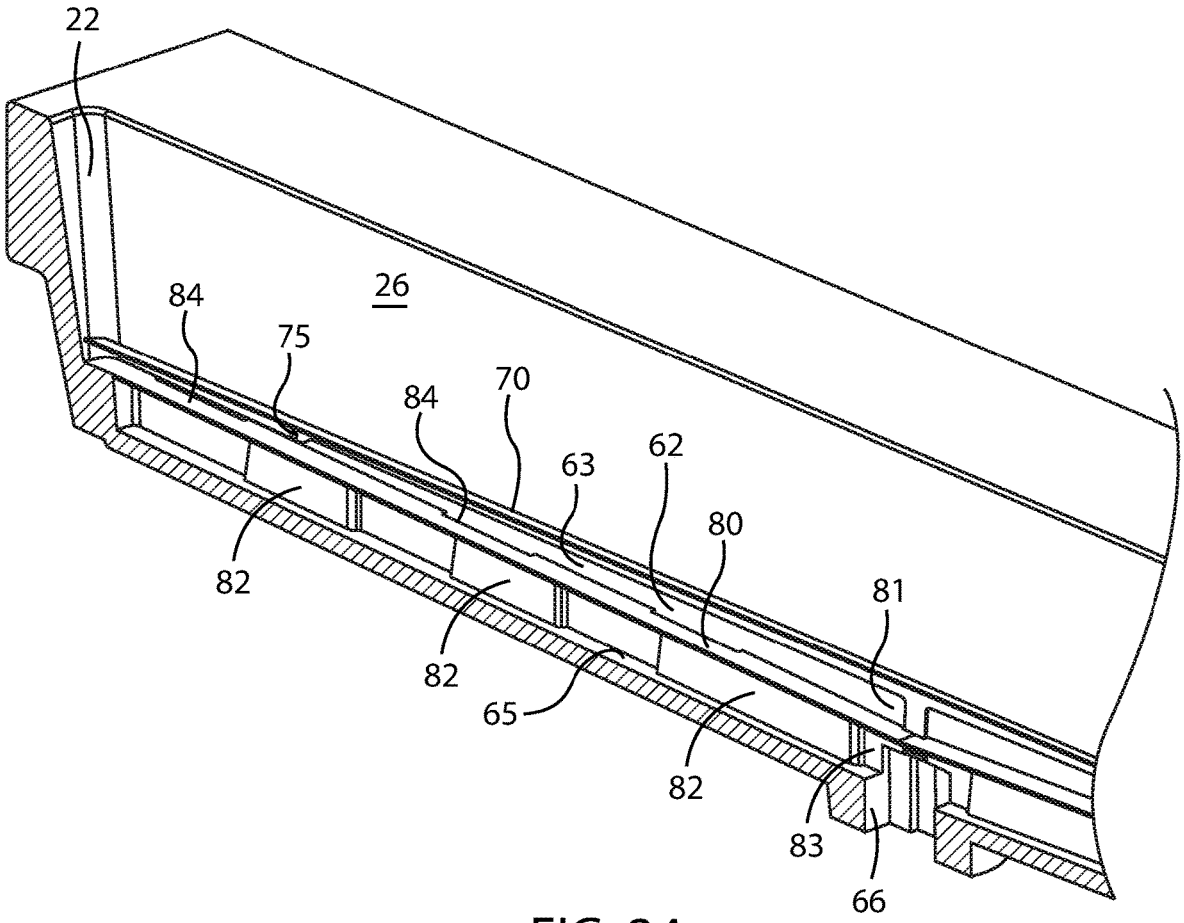
FIG. 24 is an isometric sectional view of a basin, drain channel, and drain cover for the lavatory system according to another embodiment of the drain channel.
Figure 25:
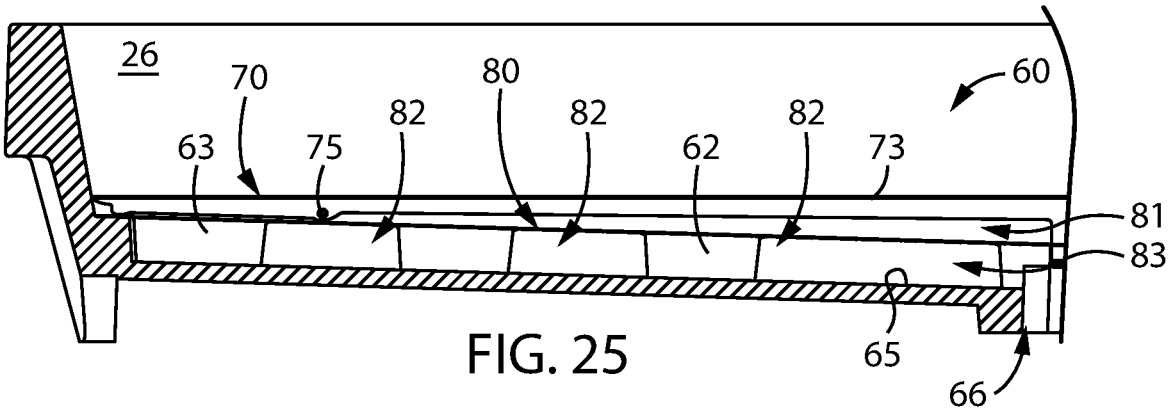
FIG. 25 is a front sectional view of the basin, drain channel, and drain cover of FIG. 24.
Figure 26:
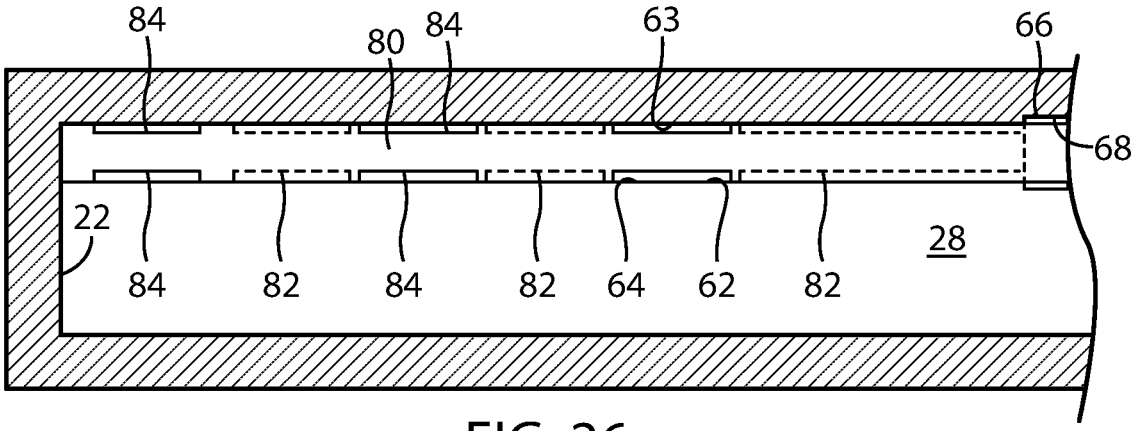
FIG. 26 is a top sectional view of the basin and drain channel of FIG. 24.
Figure 27:
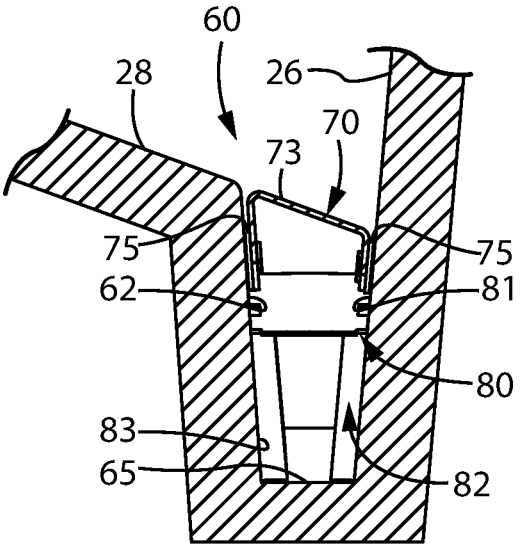
FIG. 27 is a side sectional view of the basin, drain channel, and drain cover of FIG. 24.
Figure 28:
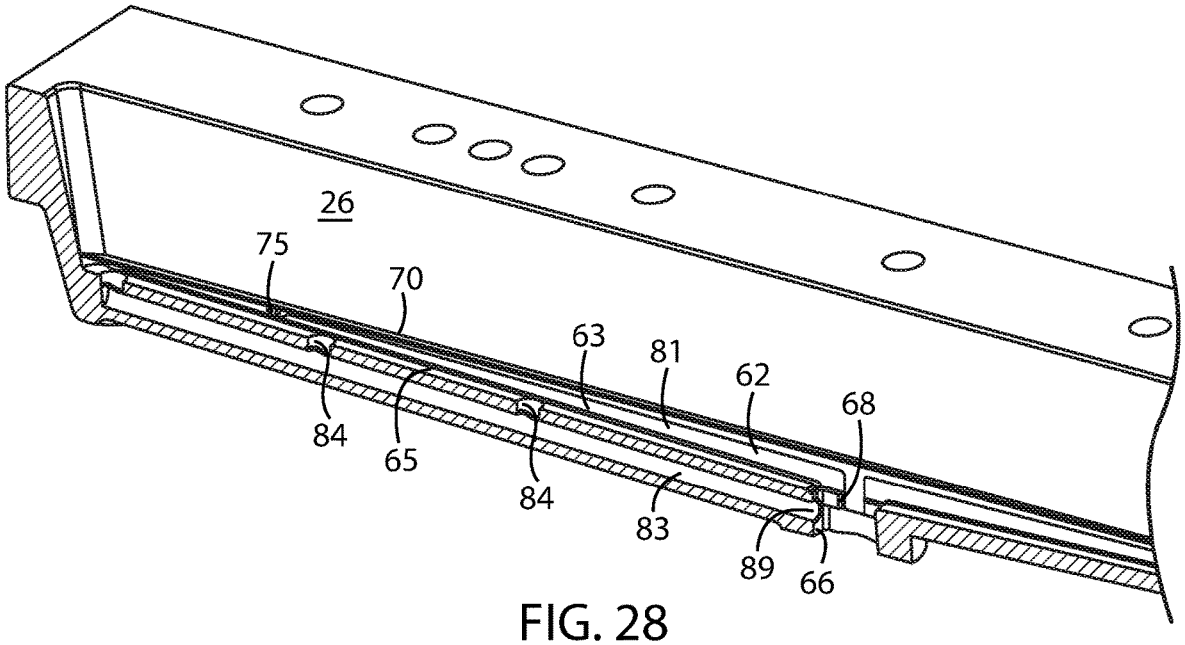
FIG. 28 is an isometric sectional view of a basin, drain channel, and drain cover for the lavatory system according to another embodiment of the drain channel.
Figure 29:
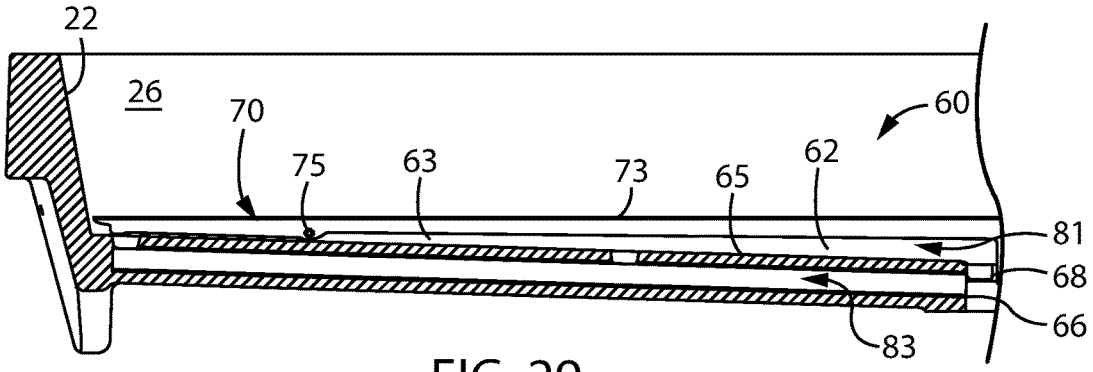
FIG. 29 is a front sectional view of the basin, drain channel, and drain cover of FIG. 28.
Figure 30:
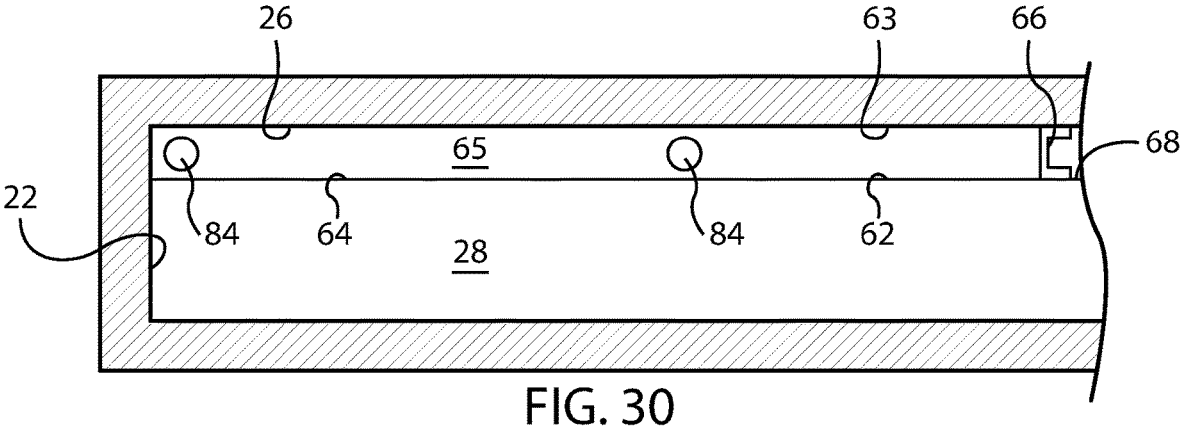
FIG. 30 is a top sectional view of the basin and drain channel of FIG. 28.
Figure 31:
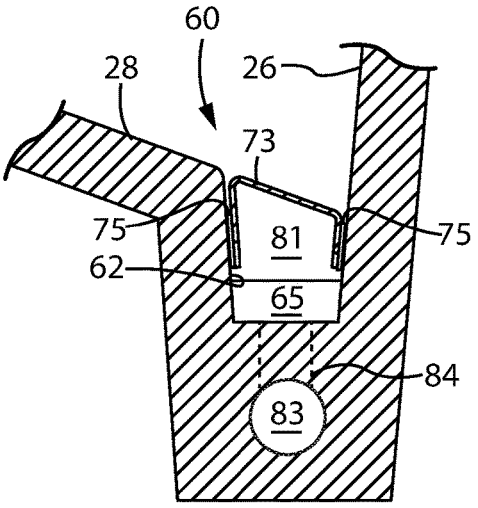
FIG. 31 is a side sectional view of the basin, drain channel, and drain cover of FIG. 28.
Figure 32:
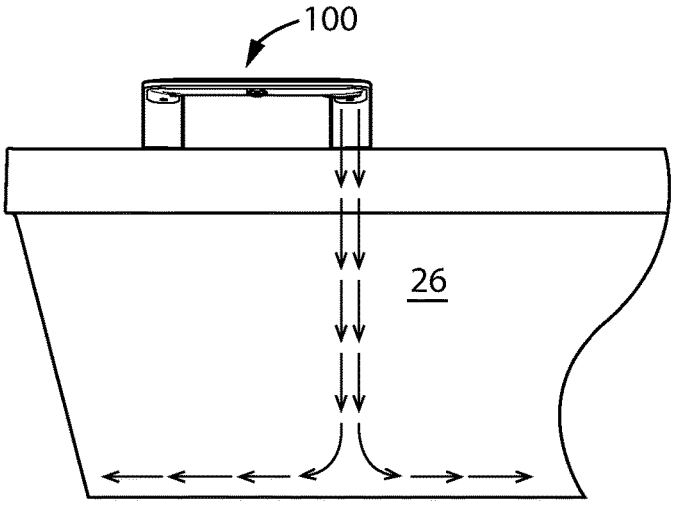
FIG. 32 is a partial flow diagram for air dispensed from the fixture according to one embodiment of the invention.
Figure 33A:
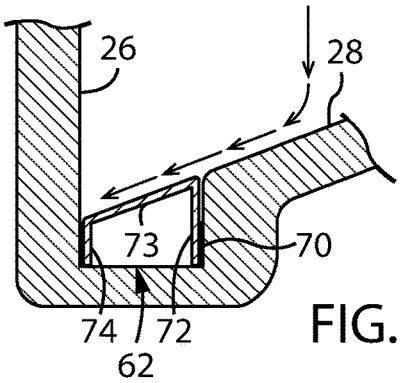
FIG. 33A is a partial flow diagram for air dispensed from the fixture across the drain cover of FIG. 22.
Figure 34A:
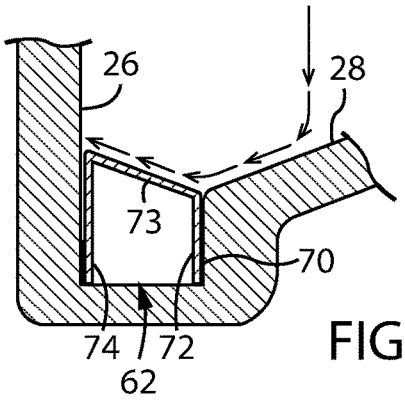
FIG. 34A is a partial flow diagram for air dispensed from the fixture across the drain cover of FIG. 23.
Figure 33B:
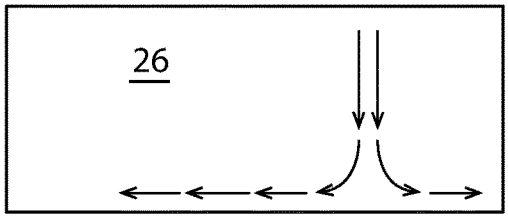
FIG. 33B is a partial flow diagram for air within the basin using the drain cover of FIG. 22.
Figure 34B:
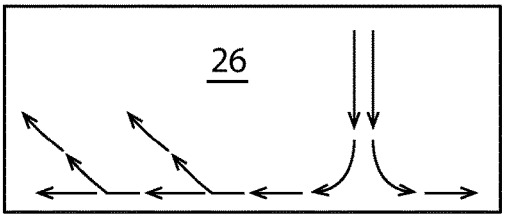
FIG. 34B is a partial flow diagram for air within the basin using the drain cover of FIG. 23.

According to another embodiment of the invention, the drain cap 70 may be configured to guide the direction of the airflow upward along the third side 26 of the basin 20. With reference to FIG. 23, the front surface 72 of the drain cap 70 may be shorter than the rear surface 74. As a result, the top surface 73 is sloped upward from the front wall 64 to the rear wall 63 of the drain channel 62. A first angle, (a, defined between the rear surface 74 and the top surface 73 of the drain cap 70 is an acute angle. A second angle, β, defined between the front surface 72 and the top surface 73 of the drain cap 70 is an obtuse angle. According to one embodiment of the invention, the drain cap 70 is configured such that the top surface 73 of the drain cap 70 angles upward at an angle similar to the downward angle of the fourth side 28 of the basin 20. As the air continues to flow from the fourth side 28 of the basin onto the top surface 73 of the drain cap 70 it is deflected upward. As the airflow intersects the third side 26 of the basin 20, the air is further deflected both to the left and the right along the third side 26 of the basin. Thus, rather than traveling along the top surface 73 of the drain cap 70, the air flow travels along the third side 26 in a generally upward and outward manner, as illustrated in FIG. 34(*b*) toward the first and second sides 22, 24 of the basin 20.

Turning next to FIGS. 24-27, another embodiment of a drain system 60 is illustrated. In this embodiment, the depth of the drain channel 62 is increased. The front wall 64 and the rear wall 63 are tapered inward toward the channel 62, such that when the drain cap 70 is inserted into the channel 62, the top surface 73 of the drain cap 70 aligns in the manner discussed above. Optionally, a ridge or series of tabs may be molded along the front and rear walls 64, 63 on which the front and rear surfaces, 72, 74, respectively, of the drain cap may be supported.

A drain plate 80 is inserted into the drain channel 62 to divide the channel 62 into two chambers. An upper chamber 81 is defined between the drain cap 70 and the drain plate 80, and a lower chamber 83 is defined between the drain plate 80 and the lower surface 65 of the channel 62. A series of supports 82 are integrally formed in the rear and front walls 63, 64 of the drain channel 62 to support the drain plate 80. Each support 82 extends from the lower surface 65 of the channel 62 and for a portion of the height of the channel 62. Each support protrudes into the channel 62 from the rear and front walls 63, 64 for a short distance, sufficient to support the drain plate 80 yet allowing water to flow along the channel 62. The width of the drain plate 80 is generally equal to the width of the channel at the top of the supports 82, such that the drain plate 80 may be set into the channel and rest on each of the supports 82. In varying embodiments of the invention, it is contemplated that the drain cap 70 and the drain plate 80 may be separate elements individually installed in the drain channel 62, joined elements installed together in the drain channel 62, or a single integrated element installed in the drain channel 62.

The drain plate 80 further includes a series of openings 84 spaced longitudinally along the plate 80 to allow water to flow from the upper chamber 81 to the lower chamber 83. According to the illustrated embodiment, each opening 84 is located along on outer edge of the drain plate 80 and extends longitudinally along the drain plate 80. The openings 84 may be spaced at intervals alternately to the supports 82, such that the water may flow from the upper chamber 81 through the openings, between adjacent supports 82, and into the lower chamber 83.

The lower chamber 83 is in fluid communication with the drain opening 66. Thus, when water is dispensed into the basin 20, it runs down the fourth side 28 of the basin to the drain channel. The water flows around each edge of the drain cap 70 and into the upper chamber 81 while other debris is kept out of the drain channel by the drain cap 70. The water then flows along the upper surface of the drain plate 80 toward the drain opening. As the water flows along the upper surface of the drain plate 80, it falls through one of the openings 84 to the lower chamber 83. Once in the lower chamber 83, the water flows toward the drain opening 66 and out of the basin 20 to the drainpipe 90.

Turning next to FIGS. 28-31, another embodiment of the drain system 60 is illustrated. In this embodiment, the drain system 60 again includes two chambers to direct water to the drain opening 66. A first chamber 81 is defined by a drain channel 62 and drain cap 70 substantially the same as that discussed above with respect to FIGS. 18-22. A second chamber 83 is integrally formed within a lower surface of the basin 20. According to the illustrated embodiment, a pipe 89 is integrally molded along the rear portion of and below the basin 20. It is contemplated that the pipe 89 is positioned below the drain channel 62 and overmolded such that it is integrally formed with the basin 20. Optionally, a second housing member may be secured to the bottom of the basin 20 and along the length of the drain channel 62. The second housing member may be configured to hold the pipe 89 below the drain channel 62 as discussed above.

Whether the pipe 89 is integrally molded or separately mounted below the basin 20, a series of openings 84 are formed through the lower surface 65 of the drain channel 62 and into the pipe 89. The openings 84 may be formed, for example, by drilling holes through the lower surface 65 and into the pipe 89. The openings 84 establish fluid communication between the first chamber 81 and the second chamber 83. Thus, when water is dispensed into the basin 20, it runs down the fourth side 28 of the basin to the drain channel. The water flows around each edge of the drain cap 70 and into the first chamber 81 while other debris is kept out of the drain channel by the drain cap 70. The water then flows along the lower surface 65 of the first chamber 81 toward the drain opening 66. As the water flows along the lower surface 65 of the first chamber 81, a portion of the water falls through one of the openings 84 to the second chamber 83. The portion of the water in the second chamber 83 also flows toward the drain opening 66. Whether flowing in the first chamber 81 or the second chamber 83, the water reaches the drain opening 66 and flows out of the basin 20 to the drainpipe 90.

Although the drain channel 62 and drain cap 70 are described in detail with respect to the illustrated embodiments, it is understood that the drain channel 62 and drain cap 70 may take various shapes, where the drain cap 70 remains complementary to the drain channel 62 for insertion and removal, as would be understood to one skilled in the art without deviating from the scope of the invention.

Figure 35:
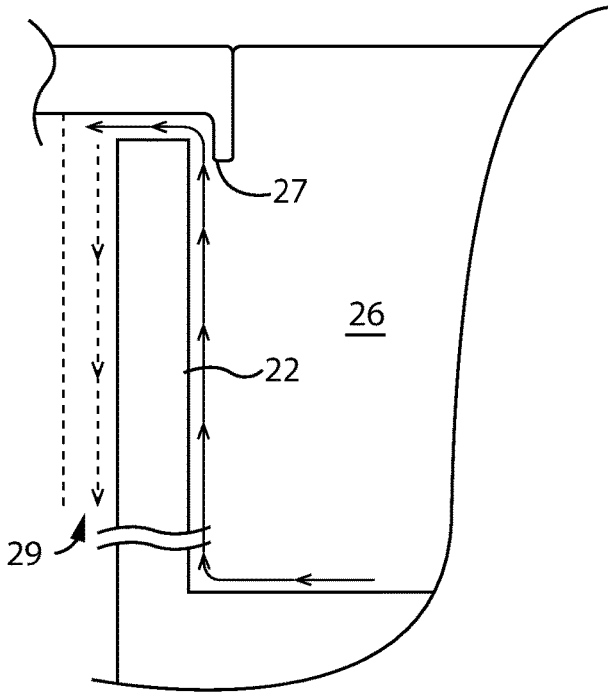
FIG. 35 is a partial flow diagram for air through an air return within the basin according to one embodiment of the invention.
Figure 36:
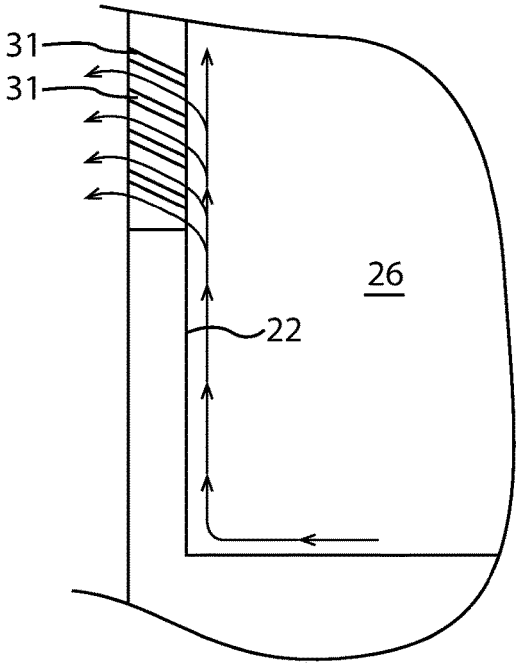
FIG. 36 is a partial flow diagram for air through an air return within the basin according to another embodiment of the invention.
Figure 37:
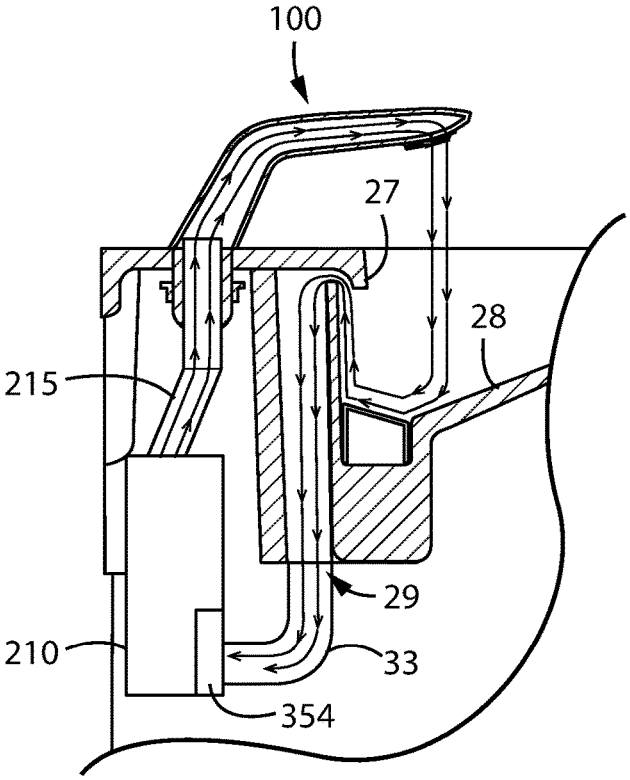
FIG. 37 is a flow diagram illustrating air recirculation from the fixture, within the basin, and back to the fan according to one embodiment of the invention.
Figure 38:
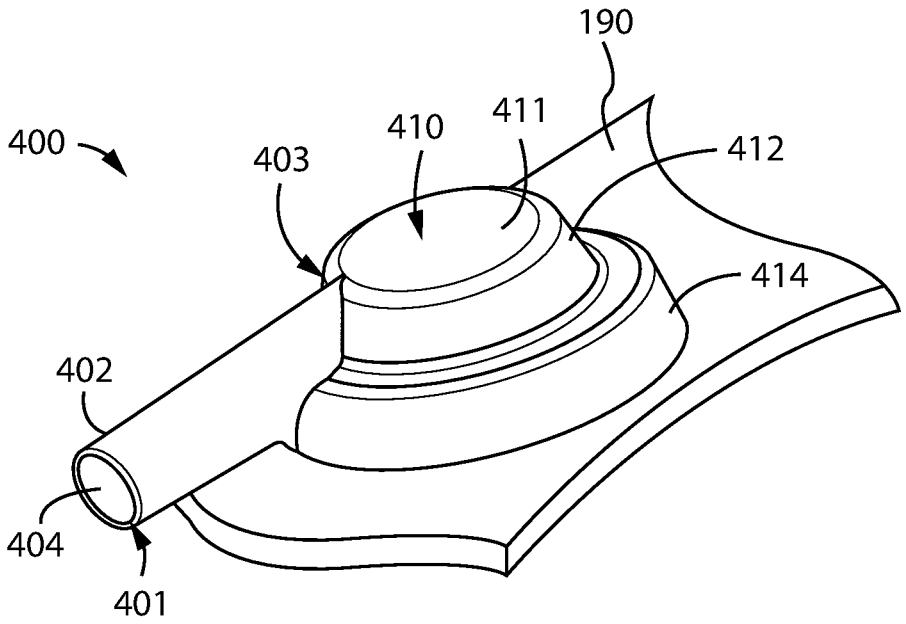
FIG. 38 is an isometric view of one embodiment of an aerator for the fixture used in the lavatory system.
Figure 39:
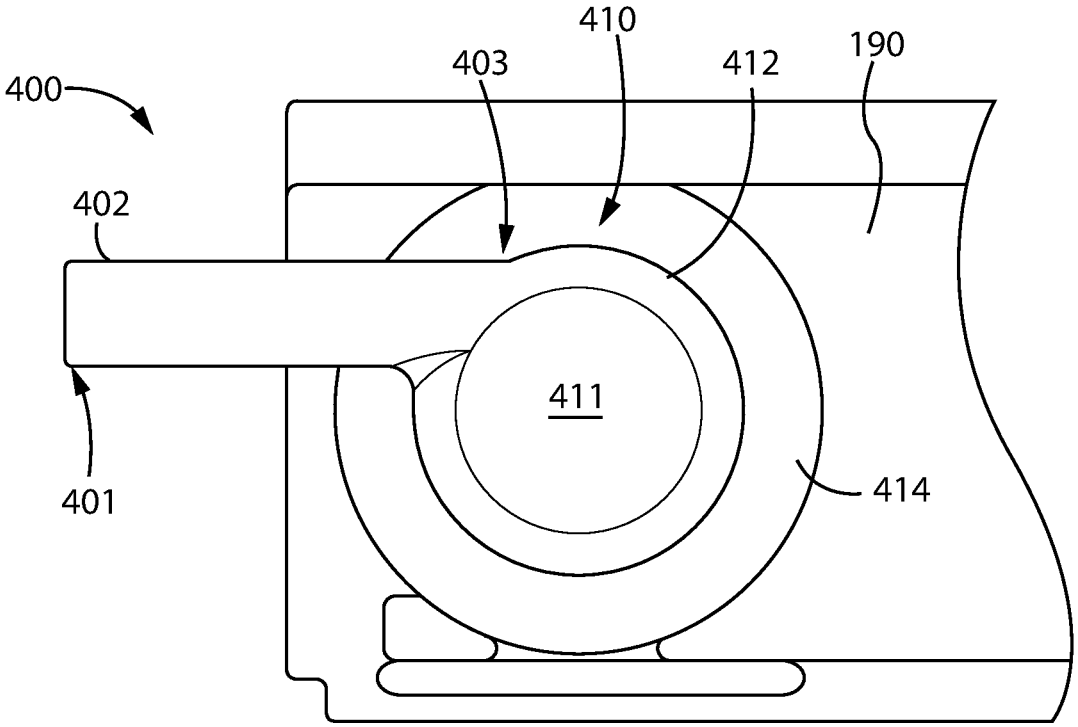
FIG. 39 is a top plan view of the aerator of FIG. 38.
Figure 40:
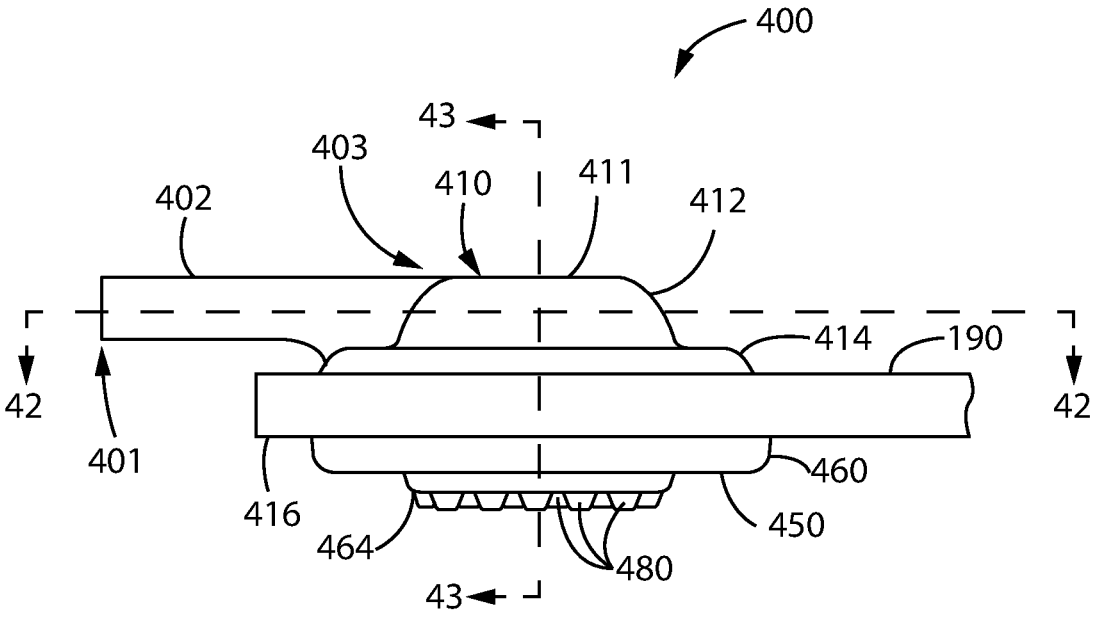
FIG. 40 is a first side elevation view of the aerator of FIG. 38.
Figure 41:
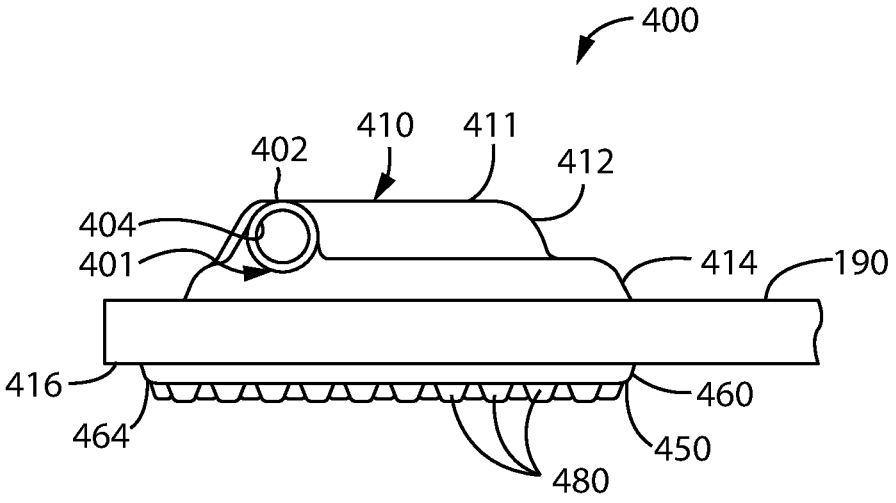
FIG. 41 is a second side elevation view of the aerator of FIG. 38.
Figure 42:
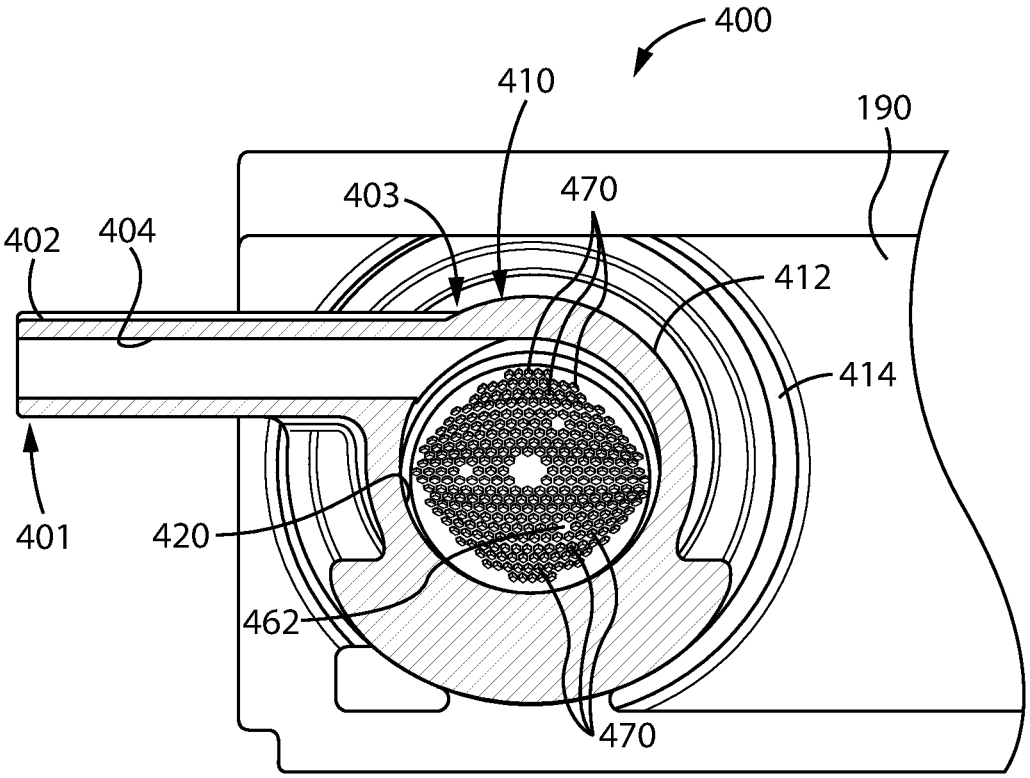
FIG. 42 is a sectional view of the aerator of FIG. 38 taken at 42-42 in FIG. 40.
Figure 43:
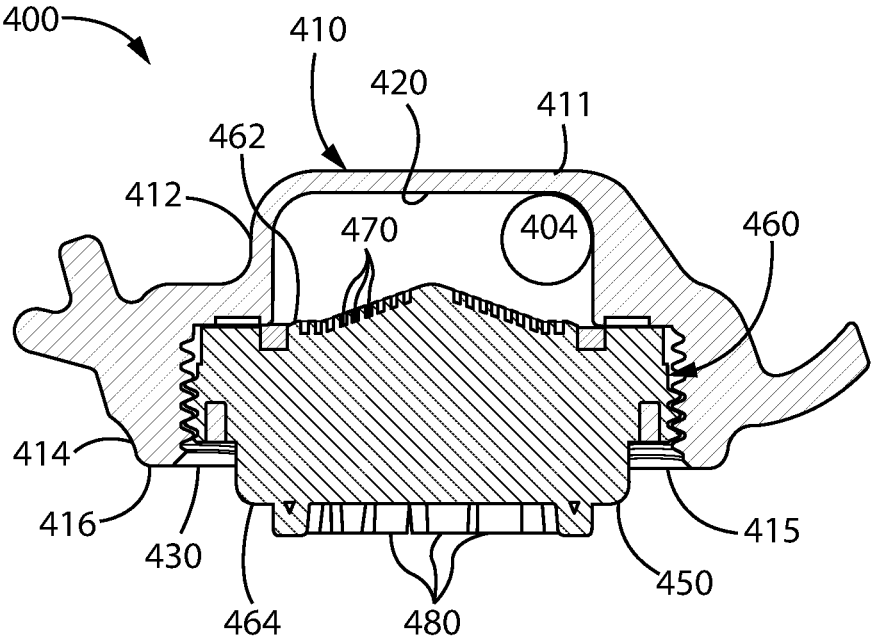
FIG. 43 is a sectional view of the aerator of FIG. 38 taken at 43-43 in FIG. 40.

Turning next to FIGS. 35-37, the basin 20 may further be configured to recirculate at least a portion of the airflow dispensed from the fixture 100. In addition to directing the airflow to the sides or up the rear of the basin 20, the basin 20 may include a ridge 27 protruding over the basin 20 to collect a portion of the airflow. The ridge may extend around the first side 22, the second side 24, or the third side 26 of the basin to capture air travelling up the side or rear of the basin 20. Optionally, a channel 29 may be formed on the rear side of the basin 20 which directs the airflow back down the outside of the basin 20 under the deck 12. The airflow may be channeled to a return duct 33 which in turn provides air to the input of the fan 210. Preferably, a filter 354 is included between the return duct 33 and the input to the fan 210 to remove water, soap, dirt, and other contaminants from the airflow prior to returning the air to the fan 210.

According to another embodiment of the invention, the basin 20 may include an opening in the side of an upper portion of the basin. The opening may include a series of louvers 31 to prevent water dispensed from the fixture 100 from entering the opening. The airflow travelling up the sides may enter the opening. Similar to the embodiment including a ridge 27, a channel 29 may be provided on the rear of the basin and the airflow directed back toward the fan 210.

The lavatory system 10 also includes a multi-function fixture 100 located at each hand washing station for the lavatory system 10. According to the illustrated embodiment, the lavatory system 10 includes two wash stations. It is contemplated that the lavatory system 10 may be configured with a single wash station and have just one fixture 100 or, optionally, the lavatory system 10 may be configured with three or more wash stations, where each wash station has a separate fixture 100. The width of the lavatory system will vary according to the number of wash stations present.

Turning next to FIGS. 6-10, a multi-function fixture 100 for the lavatory system 10 according to one embodiment of the present invention is illustrated. The fixture 100 includes a pair of legs 110. When viewed from the front, a first leg 110*a* is positioned to the right side of the fixture 100 and a second leg 110*b* is positioned to the left side of the fixture 100. The exterior of each leg 110*a*, 110*b* is mirrored about a center axis 101 of the fixture 100. For convenience, therefore, a single leg 110 will be discussed in detail, where the discussion will be equally applicable to the right leg 110*a* and the left leg 110*b*.

According to the illustrated embodiment, the leg 110 has a first end 112 configured to be mounted to the deck 12 and a second end 114 extending over the basin 20. A mounting surface 113 on the first end 112 of the leg 110 engages the upper surface 14 of the deck 12. The leg 110 includes a generally rectangular cross-section where the cross-section decreases in size between the first end 112 and the second end 114 of the leg 110. When mounted to the deck 12, the leg 110 slopes forward as it extends upward from the deck 12. From a side-view, the leg 110 is generally r-shaped. The leg 110 extends upwards from the deck 12 and forwards toward the basin 20. After extending for a height, H, a bend 115 in the leg causes the leg to protrude in a generally horizontal plane for a length, L, until the second end 114 of the leg is positioned over the basin 20.

Figure 11:
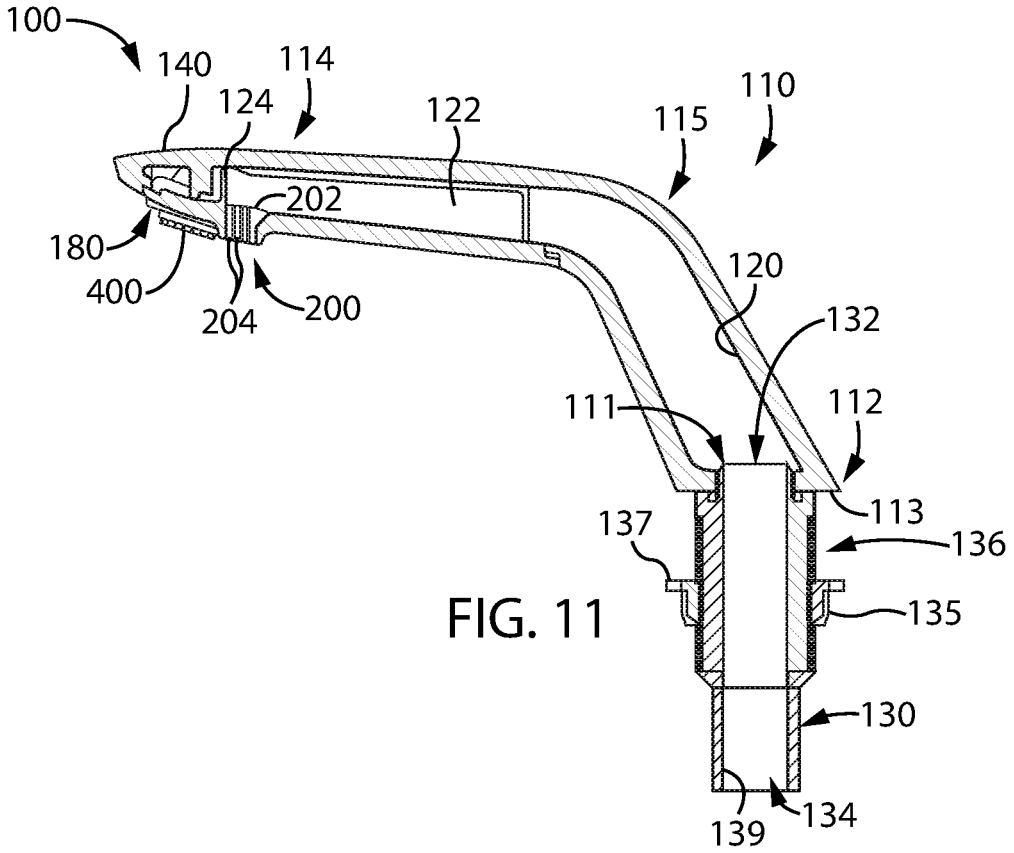
FIG. 11 is a sectional view of the multi-function fixture of FIG. 7 taken at 11-11.
Figure 12:
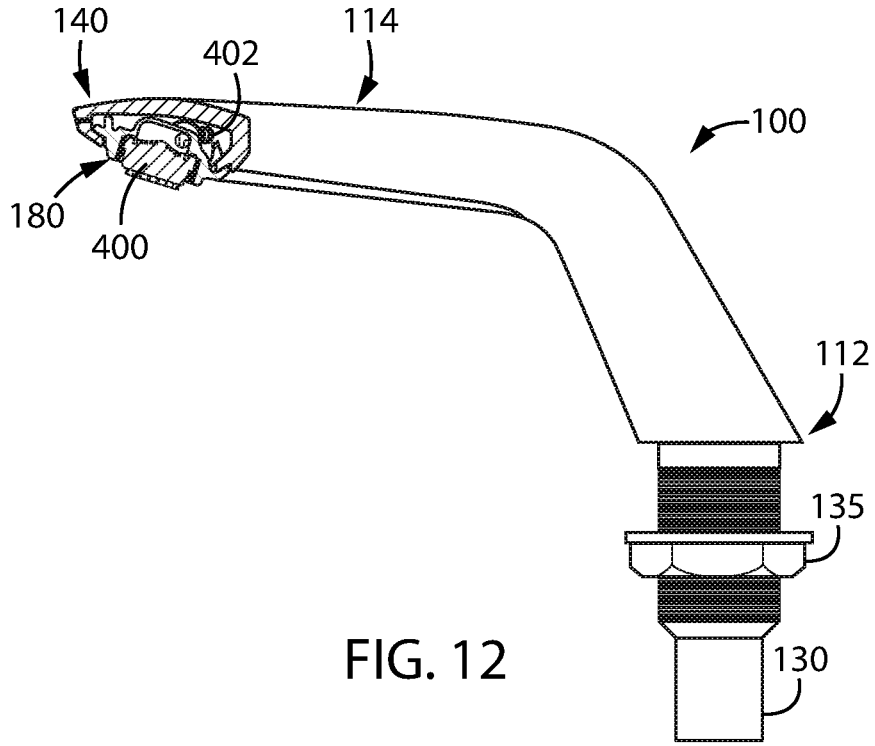
FIG. 12 is a sectional view of the multi-function fixture of FIG. 7 taken at 12-12.
Figure 13:
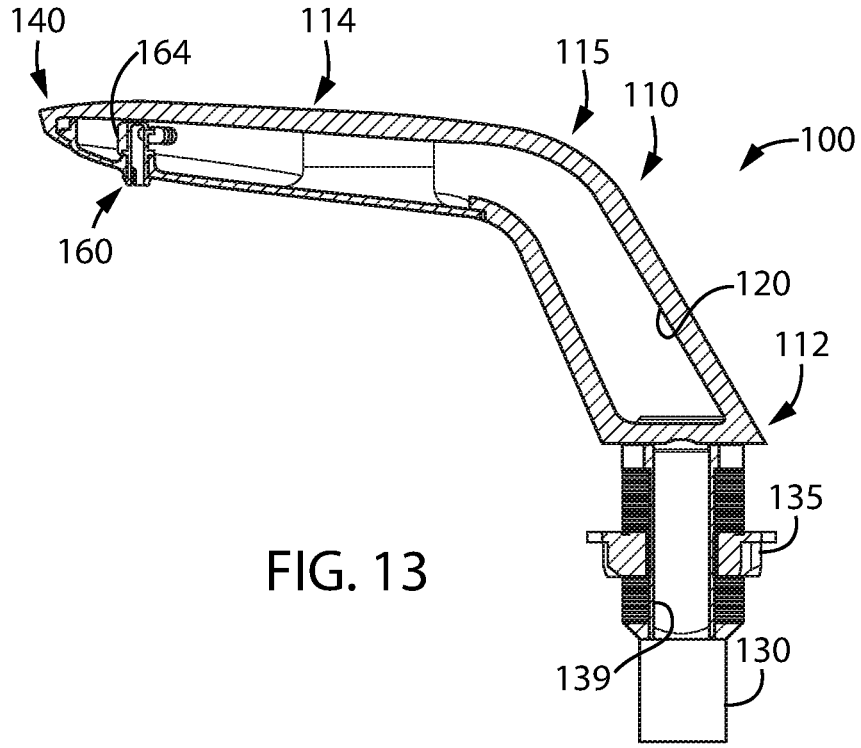
FIG. 13 is a sectional view of the multi-function fixture of FIG. 7 taken at 13-13.

With reference also to FIG. 11, the first end 112 of each leg 110 is configured to be mounted to the deck 12. An opening 111 extends through the mounting surface 113 and is in communication with a passage 120 within the leg 110. A base 130 is received within the opening 111 and secures the fixture 100 to the deck 12. The base 130 also includes a passage 139 extending therethrough which is in fluid communication with the passage 120 in the leg 110. According to the illustrated embodiment, the base 130 includes a first end 132 configured to be inserted into the leg 110 and a second end 134 configured to be inserted into an opening in the deck 12. The opening 111 in the leg 110 includes a threaded inner periphery that is complementary to a threaded outer periphery of the first end 132 of the base 130. The base 130 may, therefore, be rotatably inserted into the opening 111 such that the threads engage and positively retain the base 130 to the leg 110. It is contemplated that the base 130 may alternately be secured to the leg 110, for example, via a snap fit or other suitable securing method. According to another embodiment, the base 130 is integrally molded with the leg 110 such that a portion of the leg 110 extends through the opening to secure the fixture 100 to the deck 12. A second section 136 of the base 130 is displaced longitudinally along the base 130 such that is configured to be located, at least in part, below the deck 12. The second section 136 includes a threaded outer surface to receive a nut 135, and an upper surface 137 of the nut 135 is configured to engage the lower surface of the deck 12. To secure the fixture 100 to the deck 12, the base 130 is affixed to each leg 110 and inserted through the opening in the deck 12. The nut 135 is threaded onto the base from below the deck such that the upper surface 137 of the nut 135 and the mounting surface 113 of the leg 110 engage opposite surfaces of the deck 12 and secure the fixture 100 to the deck 12.

A connecting section 140 extends between the second ends 114 of each leg 110. The connecting section 140 has a first end 142 connected to the second end 114*a* of the first leg 110*a* and a second end 144 connected to the second end 114*b* of the second leg 110*b*. The cross-section of the first end 142 of the connecting section 140 is the same as the cross-section of the second end 114*a* of the first leg 110*a* and the cross-section of the second end 144 of the connecting section 140 is the same as the cross-section of the second end 114*b* of the second leg 110*b*. Consequently, the fixture 100 appears as a continuous unit as it transitions between each leg 110 and the connecting section 140. Further, it is contemplated that at least a portion of the first leg 110*a*, the second leg 110*b*, and the connecting section 140 may be cast, or otherwise manufactured, as a single unit. As a result, despite identifying ends of the legs 110 and ends of the connecting section 140, the locations of the ends are for illustrative purposes and may be moved axially along the leg or along the connecting section 140 without deviating from the scope of the invention.

Figure 15:
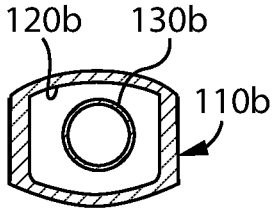
FIG. 15 is a sectional view of one leg of the multi-function fixture of FIG. 7 taken at 15-15.
Figure 16:
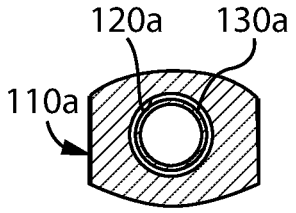
FIG. 16 is a sectional view of one leg of the multi-function fixture of FIG. 7 taken at 16-16.

The connecting section 140 includes multiple outlets for dispensing product over the basin 20 of the lavatory system 10. A first outlet 160 is operable to dispense soap, a second outlet 180 is operable to dispense water, and a third outlet 200 is operable to dispense air. The outlets 160, 180, 200 are spaced apart along the connecting section 140 such that a user's hands move along the connecting section 140 between outlets during the washing process. Each leg 110 includes a passage 120 defined within the interior of the leg for delivery of a product to one of the outlets. The soap and water may be delivered via tubes extending from below the deck 12 up through the passage 120 in one of the legs 110 the respective outlet. The passage 120 within one of the legs 110 is configured as an air duct to, at least in part, convey air from a blower located below the deck 12 to the air outlet. With reference also to FIGS. 15 and 16, exemplary sectional views of the passage 120 in each leg are illustrated. The passage 120*b* in the second leg 110*b* has a maximum sectional area to provide room for the tube 162 carrying soap and the tube 182 carrying water to be run through the passage 120*b*. The passage 120*a* in the first leg 110*a* has a sectional area closely corresponding to the passage 139 in the base 130*a*. By having the sectional areas of the passage 120*a* in the leg 110*a* and the passage 139 in the base 130*a* correspond to each other, the turbulence of the air flow is reduced as the air passes from the base 130*a* into the leg 110*a*. The passage 120*a* of the leg 110 then forms a duct through which the air is conveyed to the air outlet 200.

The connecting section 140 may also include indicators to a user identifying the location of each outlet. According to the illustrated embodiment, openings 103 are located along the front edge of the connecting section 140 through which an indicator may be displayed. A multi-color light-emitting diode (LED) 305, or red-green-blue LED array, (see also FIG. 17) is located behind each opening 103. It is contemplated that each opening may have a lens or be a translucent material rather than an opening to prevent soap, water, dirt, or other contaminants from entering the fixture 100. The LED 305 may emit different colors according to operation or flash to direct a user's attention to the location. Optionally, larger displays utilizing, for example, a liquid crystal display (LCD) may provide a graphical or other visual indication to the user of the purpose of each outlet located by the indicator.

The system for dispensing soap includes a soap reservoir, pump, and tubing to connect the pump to the soap outlet 160. The soap reservoir 310 and soap pump 316 are represented in block diagram form in FIG. 17. The soap reservoir 310 may include a level detection switch 312, such as a float switch, which generates a level detection signal 314, provided to a control circuit 302, corresponding to the amount of soap remaining in the reservoir 310. The pump 316 is activated by one or more sensors 301 located in the fixture 100 detecting the presence of a user's hands by the soap outlet 160. The pump 316 draws soap from the reservoir 310 and into a tube 162 connected between the pump 316 and the soap outlet 160. The tube is run inside the passage 120 in either the first leg 110*a* or the second leg 110*b* and into the connecting section 140 of the fixture. In the connecting section 140, the tube 162 is fit onto a nozzle 164 which extends through the outlet 160. The soap is discharged from the nozzle 164 through the outlet 160 onto a user's hands.

The system for dispensing water includes one or more inlet lines 322, connected to a water supply, one or more valves 320, and one or more outlet lines 324 to supply water to the water outlet 180. The inlet line 322 may be connected to a cold water supply, a hot water supply, or to a mixed water supply, where the mixed water supply includes a combination of hot and cold water. It is desirable to provide water at a comfortable temperature to the user. Therefore, a mixing valve may be provided in advance of the inlet line 322 that combines cold and hot water proportionally to supply water at a desired temperature. Optionally, the valve 320 may be a mixing valve which includes a first inlet line 322 from the cold water supply and a second inlet line 322 from a hot water supply. A signal 326 from the control circuit 302 may control the valve 320 not only in an on/off manner, but also in a proportional manner to mix the cold and hot water to supply water at a desired temperature. The outlet line 324 from the valve 320 is connected via a second tube 182 to the water outlet 180. An aerator 400 may be provided within the water outlet 180 includes a water inlet 402 to which the outlet line 324 from the valve 320 is connected.

Referring next to FIGS. 38-43, one embodiment of the aerator 400 is illustrated. The aerator 400 includes an upper housing 410 and a lower housing 450. According to the illustrated embodiment, the upper housing 410 is integrally formed with a removable plate 190 that may be inserted into and removed from an opening on the lower surface of the connecting section 140 of the fixture. The upper housing 410 includes two generally cylindrical chambers. A first, intake chamber 420 is formed in the upper portion of the upper housing 410. A first wall segment 412 of the upper housing 410 extends downward from an upper surface 411 of the upper housing 410. The first wall segment 412 may join the upper surface 411 at a generally curved edge that extends around the periphery of the upper housing 410. The intake chamber 420 has a first diameter defined by the inner periphery of the first wall segment 412. A second, outlet chamber 430 is formed in the lower portion of the upper housing 410. A second wall segment 414 extends downward from the first wall segment 412 to a lower edge 416 of the upper housing 410. The second wall segment 414 has a diameter greater than the diameter of the first wall segment 412, and a generally curved edge joins the first and second wall segments 412, 414. The lower surface of the upper housing 410 is generally open and the lower edge 416 defines a generally circular opening into which the lower housing 450 may be inserted. The inner surface 415 of the second wall segment 414 is threaded and is configured to receive a complementary thread on the outer periphery 460 of the lower housing 450. According to other embodiments of the invention, it is contemplated that the lower housing 450 may be secured to the upper housing 410 by other methods, including, for example, by a snap fit, cam lock, pin, screw, or other suitable retainer.

The water inlet 402 extends outward from the first wall segment 412 and defines a fluid communication path between the second tube 182, through which the water flows, and the intake chamber 420. The water inlet 402 is generally cylindrical and includes a passage 404 extending axially through the inlet 402. The second tube 182 may be press fit onto a first end 401 of the water inlet 402 and the second end 403 of the water inlet 402 is integrally formed with the first wall segment 412. Preferably, the second end 403 of the water inlet 402 joins one side of the upper housing 410. Water flowing through the second tube 182 enters the passage 404 and exits along the inner periphery of the first wall segment 412. The water is supplied at a sufficient pressure such that the water follows the inner periphery of the first wall segment 412 swirling around the interior of the intake chamber 420.

The lower housing 450 is a generally cylindrical disk configured to be inserted into the upper housing 410. As previously indicated, the outer periphery 460 of the lower housing 450 is threaded such that the lower housing 450 may rotatably engage the complementary threaded inner surface 415 of the upper housing 410. The disk includes an upper surface 462 and a lower surface 464, opposite the upper surface. A plurality of passages 470 extend between the upper surface 462 and the lower surface 464. The upper surface 462 is sloped upward from an outer edge to the center of the upper surface 462, forming a generally conical surface. Multiple nozzles 480 protrude downward from the lower surface 464. One of the passages 470 extends through each nozzle 480, and the nozzles 480 define the water outlet 180 for the fixture 100. Because the water enters the intake chamber 420 along the inner periphery and swirls around the chamber, the water more uniformly fills the chamber than if the water entered the chamber at a central location and hit the opposing surface of the chamber. The water then exits the intake chamber 420 through each of the nozzles 480 with a generally uniform pressure and flow.

Although the aerator 400 has been described according to the illustrated embodiment, it is contemplated that the aerator 400 may be formed utilizing other members without deviating from the scope of the invention. For example, the aerator 400 may be formed as a single housing with the upper housing 410 and lower housings 450 integrally formed and either fixedly or removably mounted within the connecting section 140 of the fixture 100.

The system for dispensing air includes a fan 210 located below the deck 12 operable to deliver air to the air outlet 200. According to one embodiment of the invention, the fan 210 includes a centrifugal fan driven by a motor. The motor may be operated at variable speeds to adjust the airflow rate supplied by the fan. The fan 210 draws air in through an air inlet located within the housing 40 under the deck 12. A filter 354 may be provided at the inlet to capture contaminants present in the air prior to air entering the air inlet for the fan 210. With reference also to FIG. 5, an air duct 215 connects an outlet of the fan 210 to the passage 139 in the base 130, which is, in turn, connected to a passage 120 within the leg 110 of the fixture 100.

Figure 10:
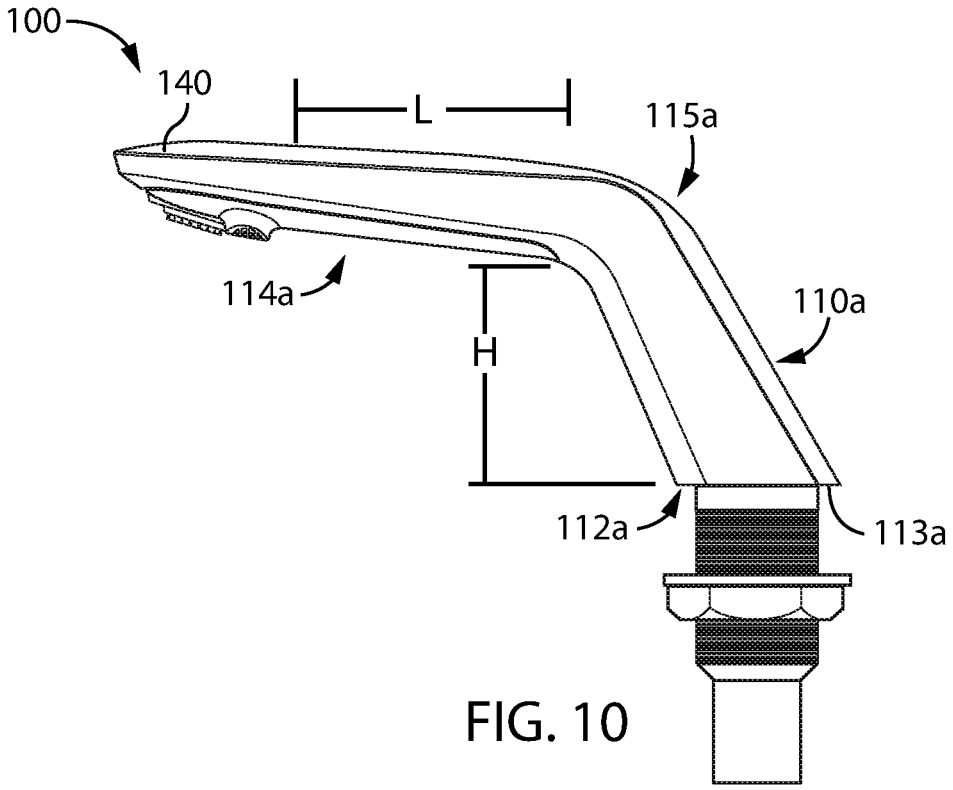
FIG. 10 is a left side elevation view of the multi-function fixture of FIG. 6.
Figure 14:
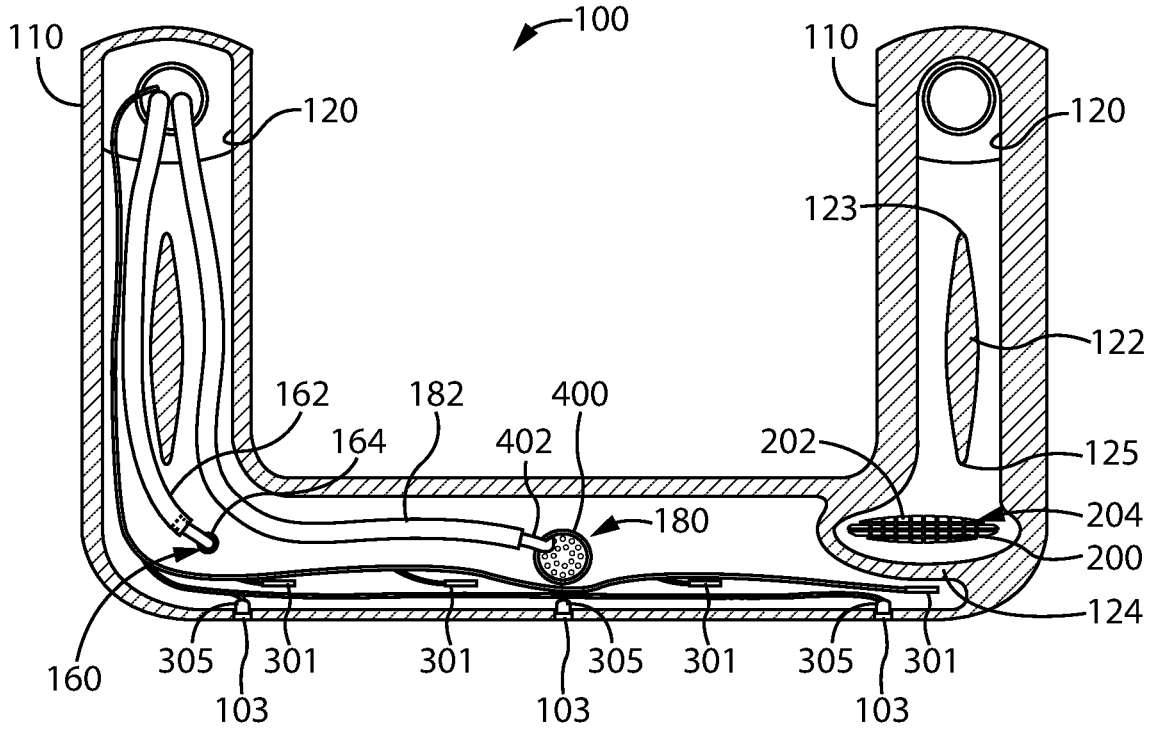
FIG. 14 is a partial top view of the multi-function fixture of FIG. 6 with the upper surface removed.

Referring to FIGS. 10, 14, and 16 the passage 120 serves as a continuation of the air duct 215 between the fan 210 and the air outlet 200. The surface of the passage 120 is preferably smooth to minimize turbulence of the air flow through the passage. A boss 122 may be provided between opposing surfaces of the passage 120 to provide improved rigidity of the fixture 100. The boss 122 includes a front end 123, indicating it receives the air flow first, and a rear end 125, indicating it receives the air flow last. The boss 122 widens toward the middle and tapers toward each end, such that each of the front and rear ends 123 and 125 are preferably narrow and rounded to minimize disturbance of the air flow through the passage 120.

An inner wall 124 is provided beyond the air outlet 200 to terminate the passage 120 and separate the air passage from other interior regions of the fixture 100. The inner wall 124 is generally orthogonal to and intersects the air flow through the passage, causing the air flow to equalize over the surface of the inner wall 124 by pressure shock when the air flow hits the inner wall 124. The air outlet 200 is located on a lower surface of the fixture 100 prior to the inner wall 124 with respect to the direction of air flow. The air outlet 200 includes a nozzle 202 with a grid 204 defined in the nozzle. Each member of the grid 204 is in a generally vertical plane to direct the airflow downward from the nozzle 202. The air flow is, therefore, directed generally ninety degrees downward and out the air outlet 200 after hitting the inner wall 124. The duct 215 from the fan and the passages 139, 120 within the base 130 and leg 110, therefore, deliver air to the air outlet 200 to dry a user's hands.

Control signals 352 pass between the fan 210 and a control circuit 302. The control signals 352 may include, for example, a start command, a stop command, a speed command, or a combination thereof to control operation of the fan 210. Feedback signals may also be provided from the fan 210 to a control circuit 302 corresponding to operation of the fan or of the condition of the filter. Although not shown, it is contemplated that the system for dispensing air may include a heater located along the air flow path to increase the temperature of the air prior to delivering the air to the user's hands.

Figure 17:
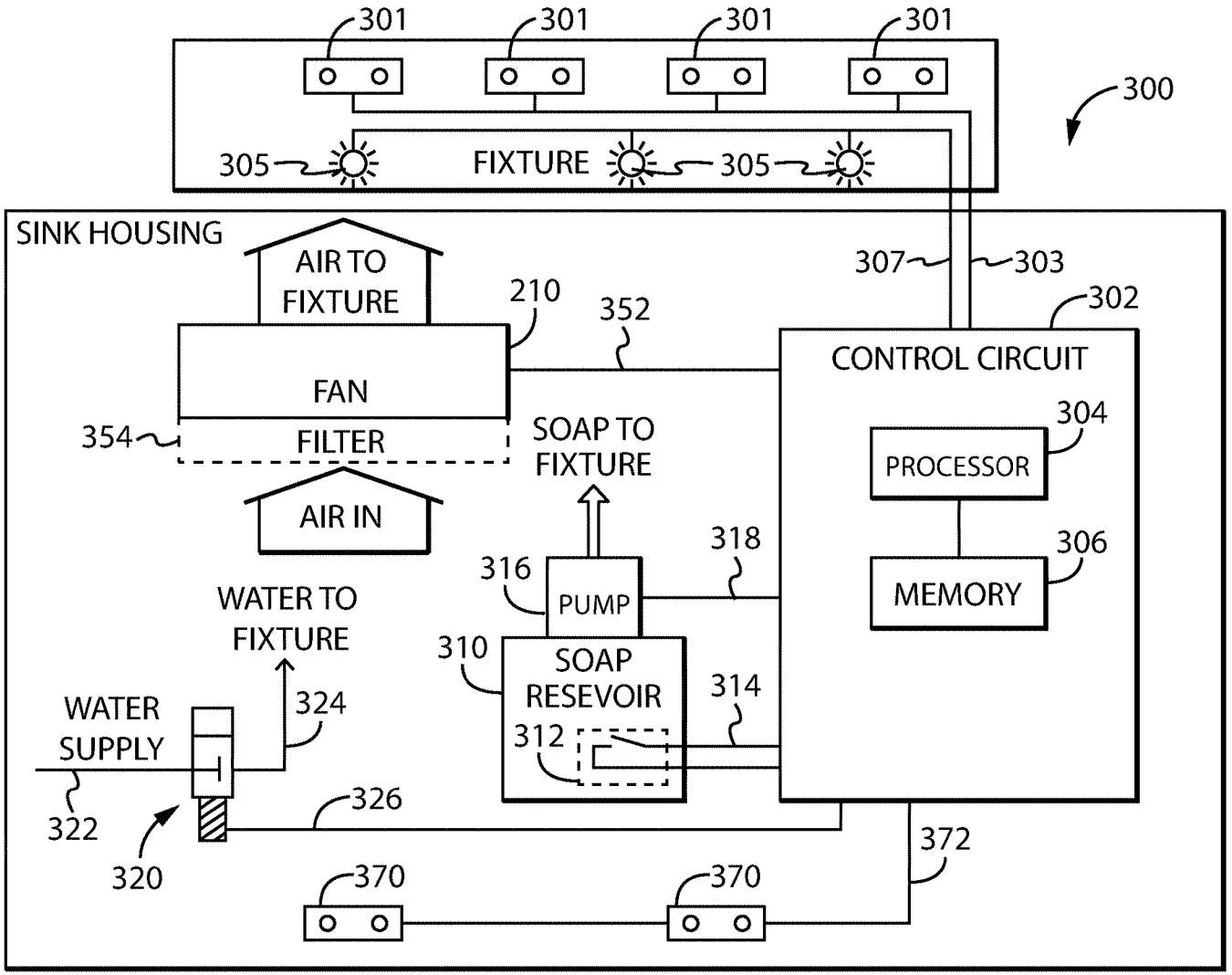
FIG. 17 is a block diagram representation of the control system for the lavatory system of FIG. 1.
Figure 18:
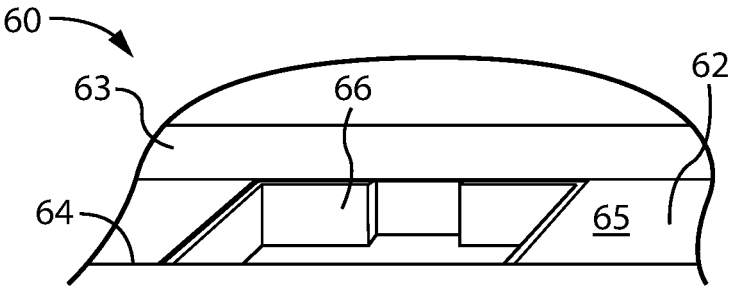
FIG. 18 is a partial isometric view of a drain for the lavatory system of FIG. 1.
Figure 19:
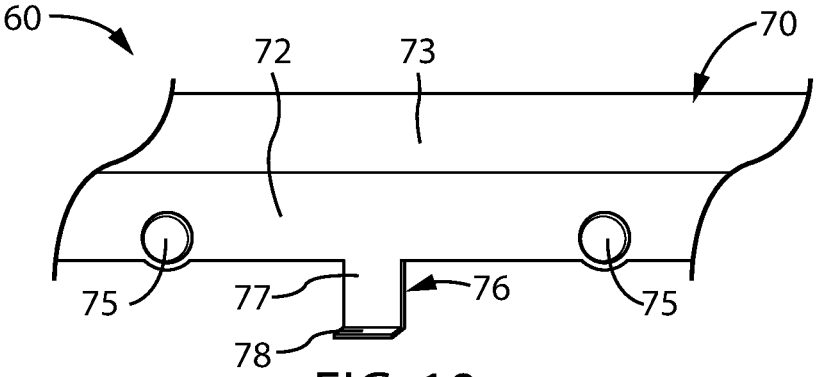
FIG. 19 is a partial isometric view of one embodiment of a drain cover for the lavatory system of FIG. 1.
Figure 20:
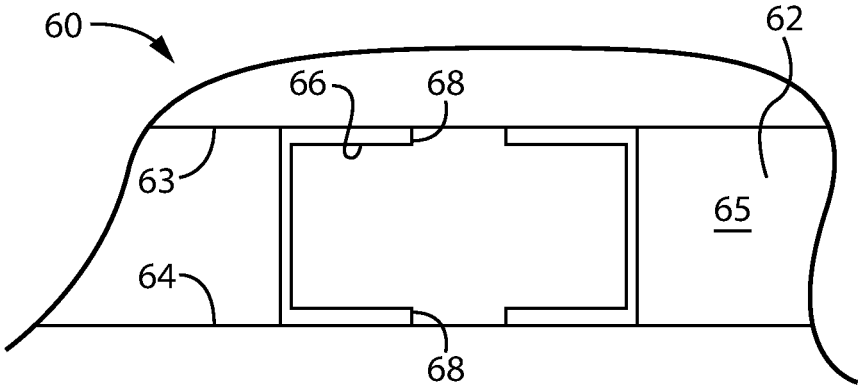
FIG. 20 is a top plan view of a drain for the lavatory system of FIG. 1.
Figure 21:
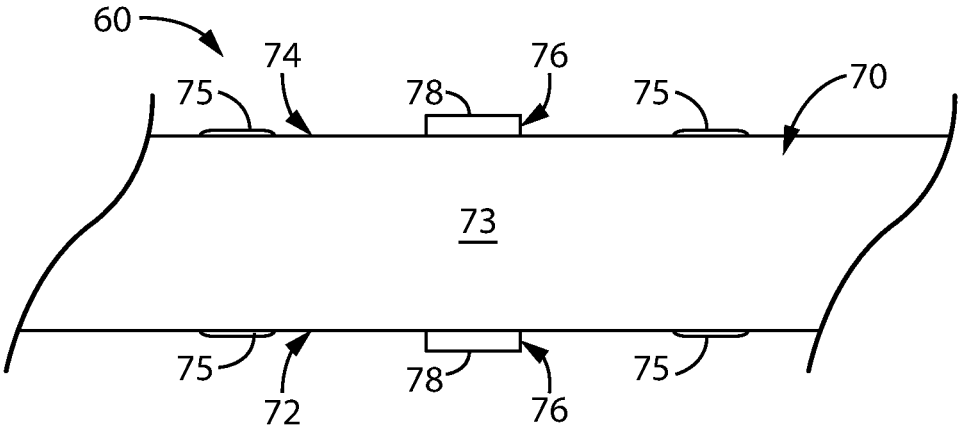
FIG. 21 is a top plan view of the drain cover of FIG. 19.

In operation, a control system 300 is provided that manages operation of the lavatory system 10. Referring next to FIG. 17, the control system 300 includes a control circuit 302 mounted to the lavatory system 10. According to one embodiment of the invention, the control circuit 302 is provided on a circuit board mounted in an enclosure below the deck 12 and within the housing 40 of the lavatory system 10 to protect the control circuit from being splashed by water. Optionally, the control circuit 302 may be potted to provide further protection from moisture in a lavatory. The control circuit 302 includes memory 306 configured to store operating parameters for the lavatory system 10 and instructions for executing on a processor 304 to control operation of the lavatory system 10. It is contemplated that the memory 306 may be volatile, non-volatile, or a combination thereof and may be a single or multiple devices. The processor 304 is operable to execute the instructions stored in memory 306 to achieve a desired operation of the lavatory system 10. It is contemplated that the processor 304 may be a single device or multiple devices. The control circuit 302 further includes other analog and/or digital devices to receive feedback signals from sensors, transmit control signals to actuators, and manage other such control related functions as would be understood in the art. It is further contemplated that the control circuit 302 may be located entirely on a single circuit board and located within a single enclosure or, optionally, portions of the control circuit 302 may be distributed about the lavatory system 10 without deviating from the scope of the invention.

The control circuit 302 receives feedback signals 303 from sensors 301 in the fixture 100 indicating a user's hands are present for washing and/or drying proximate the fixture 100. According to the illustrated embodiment, four sensors 301 are provided in the fixture 100 to control the soap, water, and air delivery from the fixture 100. According to another embodiment, it is contemplated that three sensors 301 may be provided where a single sensor 301 is located proximate to each outlet. According to still another embodiment more than four sensors 301 may be provided. It is contemplated that each sensor 301 is located within the connecting section 140 of the fixture and above the lower wall of the connecting section 140. A portion of the lower wall may include an opening 103 through which the sensor may transmit a signal, such as a radio frequency (RF) or an infrared signal. The signal is reflected off the user's hands and received at the sensor 301 to detect the presence of the user's hands. If a line-of-sight sensor is used it is contemplated that a portion of the lower housing may be made of a translucent material as an alternative to providing an opening, allowing the emitted sensor signal to pass through. Optionally, a lens may be inserted in the opening 103 to allow the emitted signal to pass and to prevent water, soap, dirt, or other contaminants from entering the opening. According to another embodiment, the sensor 301 may emit a signal capable of passing through the housing of the connecting section 140. For example, a magnetic field may be generated and a disturbance in the field due to the presence of a user's hands may be detected. Still other sensing technology, such as capacitive sensing of a user's hands may be utilized without deviating from the scope of the invention.

Including more sensors 301 than outlets allows the control circuit 302 to determine information about the location and/or direction of approach for a user's hands in addition to just being located proximate to an outlet. According to the illustrated embodiment, the two inner sensors 301 may be located on either side of the water outlet 180. As a user's hands approach the water outlet 180 after receiving soap, one of the inner sensor 301 located on the same side of the water outlet 180 as the soap outlet 160 is activated first. If a user's hands are approaching the water outlet 180 from the hand dryer side of the fixture 100 the other inner sensor 301 is activated first. When the user's hands area located under the water outlet 180, both of the inner sensors 301 are arranged to detect the hands. The control circuit may generate different control signals responsive to the sequence in which the inner sensors are activated.

Looking first at the control of the soap system, at least one sensor 301 is located near the soap outlet 160 to detect a user's hands located below the outlet 160. When a user's hands are located beneath the soap outlet 160, the sensor 301 generates a feedback signal 303 to the control circuit indicating their presence. In response to receiving the feedback signal 303, the control circuit 302 may flash or change the color of the LED 305 for the soap outlet 160 to provide an indication to the user that the hands were detected by the soap outlet 160. The control circuit 302 may also generate a control signal 318 to the soap pump 316, causing it to activate such that soap is dispensed. The soap pump 316 may be energized for a predefined period of time or execute one or more fixed pumping cycles, drawing soap from the reservoir 310 and up through the soap tube 162 to the soap nozzle 164 where it is dispensed onto the user's hands. It is further contemplated that the sensor 301 proximate the soap outlet 160 may be configured to detect a user's hands for only a short distance below the fixture 100. For example, the user's hand may need to be within three inches or within two inches of the sensor 301 to detect their presence. This detection distance is preferably configurable within the sensor 301 and may be set less than the detection distance of the water outlet as will be discussed in more detail below.

The controller 302 may further be configured to interlock the soap dispenser based on other activity at the fixture 100. For example, if the air dryer is active, it may be desirable to prevent soap from being dispensed such that it is not blown around the basin. Further, it may be desirable to require a user to remove their hands prior to dispensing additional soap. This prevents continued dispensing of soap if the user leaves their hands under the soap outlet 160 for an extended period of time or if, for example, a foreign object falls in the basin 20 under the fixture 100 proximate the soap outlet 160.

A level detection sensor 312, such as a float switch, may be provided within the reservoir. The level detection sensor 312 generates a feedback signal 314 to the control signal when the soap level is low and requires refilling. The control circuit 302 may activate the LED 305 proximate the soap outlet 160 in a manner indicating the soap level is low. For example, the control circuit 302 may flash the LED 305 or turn the color of the LED to red indicating that the level is low.

Turning next to control of the water system, at least one sensor 301 is located near the water outlet 180 to detect a user's hands located below the outlet 180. When a user's hands are located beneath the water outlet 180, the sensor 301 generates a feedback signal 303 to the control circuit indicating their presence. In response to receiving the feedback signal 303, the control circuit 302 may flash or change the color of the LED 305 for the water outlet 180 to provide an indication to the user that the hands were detected by the water outlet 180. The control circuit 302 may also generate a control signal 326 to the water valve 320, causing it to activate such that water is dispensed. The water valve 320 may be energized for a predefined time or may remain on while the user's hands are detected under the water outlet 180.

It is further contemplated that the sensor 301 proximate the water outlet 180 may be configured to detect a user's hands below the fixture 100 for a distance equal to the height of the fixture 100 above the basin 20. As a result, the user's hands will be detected at any height between the water outlet 180 and the basin 20. This detection distance is preferably configurable within the sensor 301 and may be set greater than the detection distance of the soap outlet. Requiring the user to position their hands closer to the soap outlet to receive soap than is required to dispense water will help prevent inadvertent dispensing of soap. For example, as a user rinses the soap from their hands under the water outlet 180, the hand, arm, or a portion thereof may move under the soap outlet 160. However, a user typically positions their hands at a distance below the water outlet 180 to avoid water splashing or spraying from their hands or from making contact with the fixture 100 while rinsing the hands. The distance users typically position their hands is greater than the distance at which the sensor 301 proximate the soap outlet is set for detection. As a result, even if a portion of the user's hands or arm moves under the sensor 301 for the soap while using the water outlet 180, additional soap is not dispensed.

The control circuit 302 may further be configured to provide interlocks in dispensing water from the fixture 100. For example, if the air dryer is active, it may be desirable to prevent water from being dispensed such that it is not blown around the basin. Further, it may be desirable to require a user to remove their hands from beneath the water outlet 180 and stop dispensing water to dispensing air. A maximum duration may also be configured for which the water outlet 180 may dispense water without requiring the user to remove and reinsert their hands beneath the water outlet 180. This prevents continued dispensing of water if the user leaves their hands under the water outlet 180 for an extended period of time or if, for example, a foreign object falls in the basin 20 under the fixture 100 proximate the water outlet 180.

Turning then to control of the air system, at least one sensor 301 is located near the air outlet 200 to detect a user's hands located below the outlet 200. When a user's hands are located beneath the air outlet 200, the sensor 301 generates a feedback signal 303 to the control circuit indicating their presence. In response to receiving the feedback signal 303, the control circuit 302 may flash or change the color of the LED 305 for the air outlet 200 to provide an indication to the user that the hands were detected by the air outlet 200. The control circuit 302 may also generate a control signal 352 to the fan 210, causing it to activate such that air is dispensed. The fan 210 may be energized for a predefined time or may remain on while the user's hands are detected under the air outlet 200.

The sensor 301 proximate the air outlet 200 may be configured to detect a user's hands below the fixture 100 for a distance equal to the height of the fixture 100 above the basin 20. As a result, the user's hands will be detected at any height between the air outlet 200 and the basin 20. This detection distance is preferably configurable within the sensor 301 and may be set greater than the detection distance of the soap outlet. The motor for the fan 210 may be configured to operate at multiple speeds. It is contemplated that one speed will be selected when the lavatory system is configured, or reconfigured, and that the motor will run at that speed each time the sensor 301 detects a user's hands beneath the air outlet 200. According to one aspect of the invention, the motor speed may be selected such that a user's hands are dried within a desired time duration. The selected speed may vary, for example, as a function of the size of the fixture 100, the volume of air delivered by the fixture, or whether a heater is present within the air flow. According to another aspect of the invention, the motor speed may be selected such that the motor and air flow generate noise at an acceptable level while the user's hands are located within the air stream.

The control circuit 302 may further be configured to provide interlocks in dispensing air from the fixture 100. For example, if the air dryer is active, it may be desirable to prevent water from being dispensed such that it is not blown around the basin. Further, it may be desirable to require a user to remove their hands from beneath the air outlet 200 and stop dispensing air prior to dispensing water. A maximum duration may also be configured for which the air outlet 200 may dispense air without requiring the user to remove and reinsert their hands beneath the air outlet 200. This prevents continued dispensing of air if the user leaves their hands under the air outlet 200 for an extended period of time or if, for example, a foreign object falls in the basin 20 under the fixture 100 proximate the air outlet 200.

According to another aspect of the invention, the lavatory system 10 may include one or more approach sensors 370. Each approach sensor 370 may be mounted on an inside surface of the housing 40 and in line with one of the fixtures 100. The housing 40 may include an opening 371 through which the sensor may transmit a signal, such as a radio frequency (RF) or an infrared signal. The signal is reflected off the user as the user approaches the lavatory system 10 and received at the sensor 370 to detect the user's approach. If a line-of-sight sensor is used, it is contemplated that a portion of the housing 40 may be made of a translucent material, allowing the emitted sensor signal to pass through. Optionally, a lens may be inserted in the opening 371 to allow the emitted signal to pass and to prevent water, soap, dirt, or other contaminants from entering the opening. According to another embodiment, the sensor 370 may emit a signal capable of passing through the housing 40. For example, a magnetic field may be generated and a disturbance in the field due to the presence of a user may be detected.

Each approach sensor 370 generates a feedback signal 372 to the control circuit 302. The control circuit 302 may use the approach signal 372, for example, to bring the lavatory system 10 out of a power-saving state or may prepare the lavatory system 10 for use. In the power saving state, a portion of the control circuit 302 may be de-energized. When the approach signal 372 is detected, the lavatory system 10 may energize the entire control circuit 302 in anticipation of use. Similarly, the control circuit 302 may energize a heater, if present, to begin warming air for delivery to a user. According to yet another example, the visual indicators 305 on the fixture 100 may be energized in response to receiving the approach signal 372. Still other actions may be taken in response to the approach signal 372 at the control circuit 302 that will speed the user's hand washing experience.

According to another aspect of the invention, the lavatory system 10 is configurable using the sensors 301 in the fixture 100. Previously, configuration of a lavatory system 10 would be performed, for example, via dip switches, a rotary switch, or the like located within or near the enclosure for the control circuit 302 and contained under the deck 12 and within the housing 40 of the lavatory system 10. Changing operation such as the motor speed for the fan 210, volume of soap dispensed, duration of water flow, and the like required removing the housing 40 and accessing the switches beneath the deck 12. The present lavatory system 10 provides for configuration of the lavatory system 10 via the sensors 301 above the deck without removing the housing 40.

A user may enter a configuration mode for the lavatory system 10 by inserting the user's hands under the sensors 301 in a predefined sequence. The sequence is selected to avoid accidental entry of the configuration mode during normal operation of the lavatory system 10. For example, the sequence may require placing the right hand under a first sensor and a left hand under a second sensor where the right hand is inserted ahead of the left hand by less than a second. Both hands are then held under the sensors for at least ten seconds. According to another example, the sequence may require activating each sensor 301 in sequence from left-to-right or right-to-left multiple times in succession and subsequently holding a hand under one of the sensor 301 for a predefined time. Still other sequences may be used without deviating from the scope of the invention. Once the lavatory system 10 has entered configuration mode, each of the visual indicators 305 may provide an indication to the user of the configuration mode. The indicators 305 may, for example, turn to a unique color designating configuration mode.

The user then continues to configure the lavatory system 10 by further passing the user's hands under different sensors 301. The user may first select which system to configure, that is whether the user wishes to configure the soap dispensing system, the water dispensing system, or the air dispensing system. A particular system may be selected by inserting the user's hands under a sensor 301 proximate to the respective outlet. For example, to configure the water dispensing system, the user may insert a hand under a sensor 301 proximate the water outlet 180 and to configure the air dispensing system, the user may insert a hand under a sensor 301 proximate the air outlet 200. The visual indicator proximate the selected system may remain the color identifying configuration mode and begin to flash to indicate that the particular system has been selected. Optionally, the lavatory system 10 may contain a predefined number of parameters that are configurable via the sensors 301 and the user may increment or decrement through each parameter by inserting a hand under one of the sensors 301. Identification of the parameter may occur by briefly activating the device to be configured or by flashing a parameter number on the visual indicators.

Once a system or a particular parameter has been selected, the user again inserts a hand under one of the sensors 301. It is contemplated that a first sensor 301 may be utilized to choose a parameter for configuration and a second sensor 301 may be utilized to change the setting of the parameter. The parameter preferably has a predefined set of settings. For example, the motor for the fan may have a low, medium, and high speed setting. Each time a user inserts a hand under the second sensor 301 the setting of the parameter increments or decrements to the next setting. The lavatory system 10 may briefly activate the motor so that the user may observe the air flow resulting from the selected motor speed and determine which setting is desired.

Although the best mode contemplated by the inventors of carrying out the present invention is disclosed above, practice of the present invention is not limited thereto. It will be manifest that various additions, modifications and rearrangements of the features of the present invention may be made without deviating from the spirit and scope of the underlying inventive concept.

Moreover, the individual components need not be formed in the disclosed shapes, or assembled in the disclosed configuration, but could be provided in virtually any shape, and assembled in virtually any configuration. Furthermore, all the disclosed features of each disclosed embodiment can be combined with, or substituted for, the disclosed features of every other disclosed embodiment except where such features are mutually exclusive.

It is intended that the appended claims cover all such additions, modifications and rearrangements. Expedient embodiments of the present invention are differentiated by the appended claims.

What is claimed is:

1. A lavatory system comprising:

a basin including:

a first side extending downward to a fourth side;

a second side opposite the first side, the second side extending downward to the fourth side;

a third side extending downward, between the first and second side;

the fourth side sloped inward and downward toward the third side;

a U-shaped drain channel formed in the fourth side, the drain channel including a rear wall, a front wall extending downward from the lower surface of the basin, and a lower surface, the drain channel extends longitudinally across a width of the basin;

a drain cap removably mounted within the drain channel and extending longitudinally across a width of the basin, the drain cap including a front surface, a rear surface, and a top surface;

a longitudinal width of the drain cap extending across a width of the basin, the longitudinal width of the drain cap being substantially the same length as the drain channel;

a first chamber formed within the drain channel, below the drain cap; and a second chamber disposed below the first chamber.

2. The lavatory system of claim 1 wherein the top surface of the drain cap is coplanar with the fourth side of the basin.

3. The lavatory system of claim 1 wherein the top surface of the drain cap angles upward from the fourth side of the basin.

4. The lavatory system of claim 1 further comprising an opening formed in the lower surface of the drain channel including a plurality of notches formed therein; and a plurality of tabs on the drain cap configured to interfit with the plurality of notches of the drain channel.

5. The lavatory system of claim 1 further comprising a plurality of bumpers affixed to at least one of the front and rear surfaces of the drain cap.

6. The lavatory system of claim 5 further comprising a first space between the front surface of the drain cap and the front wall of the drain channel, the first space configured to allow the plurality of bumpers affixed to the front surface of the drain cap to fit in the first space when the drain cap is mounted with the drain channel; and a second space between the rear surface of the drain cap and the rear wall of the drain channel, the second space configured to allow the plurality of bumpers affixed to the rear surface of the drain cap to fit in the second space when the drain cap is mounted with the drain channel.

7. The lavatory system of claim 1 further comprising a drain plate inserted into the drain channel between the lower surface of the drain channel and the drain cap;

an upper chamber defined between the drain cap and the drain plate;

a lower chamber defined between drain plate and the lower surface of the drain channel; and a plurality of openings disposed along the drain plate configured to allow fluid to flow from the first chamber to the second chamber.

8. The lavatory system of claim 1 further comprising an upper chamber defined by the drain channel and the drain cap and a lower chamber disposed below the lower surface of the drain channel;

a pipe disposed below the lower surface of the drain channel; forming the lower chamber; and a plurality of openings formed in the lower surface of the drain channel to fluidically couple the upper and lower chambers.

9. The lavatory system of claim 1 wherein the top surface of the drain cap is configured to guide the direction of airflow from a fixture of the lavatory system.

10. The lavatory system of claim 9 further comprising a ridge protruding from at least one of the first side, a second side, and a third side of the basin;

a channel formed on a rear side of the basin;

wherein the ridge protrudes over the basin and is configured to collect a portion of airflow from the fixture of the lavatory system;

wherein the channel directs airflow from the basin to a return duct of a fan.

11. The lavatory system of claim 9 further comprising an opening formed in at least one of the first side, a second side, and a third side of the basin; and a channel formed on a rear side of the basin;

wherein the channel directs airflow from the basin to a return duct of a fan.

12. The lavatory system of claim 11 further comprising a series of louvres in the opening configured to prevent water from entering the opening.

13. A lavatory system comprising:

a basin including:

a first side opposite a second side, the first and second sides both extending downward to a fourth side;

a third side extending downward, between the first and second side;

the fourth side sloped inward and downward toward the third side;

a U-shaped drain channel formed in the fourth side, the drain channel including a rear wall, a front wall extending downward from the lower surface of the basin, a lower surface, and the drain channel extending longitudinally across a width of the basin;

a drain opening formed in the lower surface of the drain channel;

a fixture extending over the basin;

a drain cap removably mounted within the drain channel and extending longitudinally across a width of the basin, the drain cap including a front surface, a rear surface, and a top surface;

a first chamber formed within the drain channel, below the drain cap; and a second chamber disposed below the first chamber.

14. The lavatory system of claim 13, further comprising a drain plate inserted into the drain channel between the lower surface of the drain channel and the drain cap, the drain plate including at least one opening spaced longitudinally along the drain plate to fluidically couple the first and second chamber, the second chamber being disposed below the drain plate.

15. The lavatory system of claim 13, further comprising a pipe located below the drain channel to form the lower chamber; and at least one opening formed through the lower surface of the drain channel and into the pipe to establish fluid communication between the upper chamber and the lower chamber.

16. A lavatory system comprising:

a basin including:

a first side opposite a second side, the first and second sides both extending downward to a fourth side;

a third side extending downward, between the first and second side;

the fourth side sloped inward and downward toward the third side;

a U-shaped drain channel formed in the fourth side, the drain channel including a rear wall, a front wall extending downward from the lower surface of the basin, a lower surface, and the drain channel extending longitudinally across a width of the basin;

a drain opening formed in the lower surface of the drain channel;

a fixture extending over the basin;

a drain cap removably mounted within the drain channel, the drain cap including a front surface, a rear surface, a top surface, and the drain cap extending longitudinally across a width of the basin, configured to guide the direction of airflow from the fixture;

a channel formed behind at least one of the first side, second side, or third side of the basin to collect airflow; and an opening formed through an upper portion of the basin, allowing air flow from the basin to the channel.

17. The lavatory system of claim 16, further comprising a ridge protruding from at least the first side, the second side, or the third side of the basin to collect a portion of the airflow into the channel.

18. The lavatory system of claim 16, further comprising a series of louvers located in the opening configured to prevent water from entering the opening.

19. The lavatory system of claim 16, further comprising a return duct coupled to the channel, providing air to an input of a fan.

20. The lavatory system of claim 19, further comprising a filter included between the return duct and the input of the fan.

* * * * *